US011142294B2

(12) United States Patent
Malpede et al.

(10) Patent No.: US 11,142,294 B2
(45) Date of Patent: Oct. 12, 2021

(54) PROPULSION APPARATUS

(71) Applicant: SMAR-AZURE LIMITED, Edinburgh (GB)

(72) Inventors: Sabrina Maria Malpede, Edinburgh (GB); Donald William Macvicar, Donaghadee (GB)

(73) Assignee: SMAR-AZURE LIMITED, Edinburgh (GB)

( * ) Notice: Subject to any disclaimer, the term of this patent is extended or adjusted under 35 U.S.C. 154(b) by 65 days.

(21) Appl. No.: 16/613,219

(22) PCT Filed: May 15, 2018

(86) PCT No.: PCT/GB2018/051311
§ 371 (c)(1),
(2) Date: Nov. 13, 2019

(87) PCT Pub. No.: WO2018/211260
PCT Pub. Date: Nov. 22, 2018

(65) Prior Publication Data

US 2020/0115019 A1 Apr. 16, 2020

(30) Foreign Application Priority Data

May 15, 2017 (GB) ..... 1707771

(51) Int. Cl.
*B63H 9/02* (2006.01)
*B63H 9/06* (2020.01)
*B63H 9/067* (2020.01)

(52) U.S. Cl.
CPC ..... *B63H 9/02* (2013.01); *B63H 9/067* (2020.02)

(58) Field of Classification Search
CPC ... B63H 1/00; B63H 1/14; B63H 9/00; B63H 9/02; B63H 9/04; B63H 9/06; B63H 9/067; F15D 1/00; F15D 1/10
(Continued)

(56) References Cited

U.S. PATENT DOCUMENTS 4,602,584 A * 7/1986 North ..... B63H 9/02 114/39.3
4,630,997 A 12/1986 Cousteau et al.
8,261,681 B2 * 9/2012 Wobben ..... B63H 9/02 114/39.3

FOREIGN PATENT DOCUMENTS

DE 525706 5/1931
FR 2 495 242 12/1980
(Continued)

OTHER PUBLICATIONS

International Search Report for PCT/GB2018/051311 dated Aug. 29, 2018, 3 pages.

*Primary Examiner* — Lars A Olson
(74) *Attorney, Agent, or Firm* — Nixon & Vanderhye P.C.

(57) ABSTRACT

Propulsion apparatus for an aquatic vessel comprises an aerodynamic body which extends along a longitudinal axis between first and second ends and in a transverse direction between a leading edge and trailing edge. The aerodynamic body has one or more external wind-receiving surfaces which extend between the leading edge and the trailing edge, thereby defining an aerodynamic profile of the aerodynamic body in cross-section substantially perpendicular to the longitudinal axis. The propulsion apparatus further comprises at least one air vent and at least one air flow generator configured to expel air through the at least one air vent. The at least one air vent and/or the at least one air flow generator
(Continued)

are configured to direct expelled air across at least a portion of the one or more or more external wind-receiving surfaces.

19 Claims, 9 Drawing Sheets

(58) Field of Classification Search
USPC ..... 114/39.3; 416/4, 90 A; 440/8
See application file for complete search history.

(56) References Cited

FOREIGN PATENT DOCUMENTS

| | | |
|---|---|---|
| FR | 2 503 286 | 12/1980 |
| FR | 2 847 009 | 5/2004 |
| FR | 3 035 861 | 11/2016 |
| NL | 2006560 | 10/2012 |

* cited by examiner

Fig. 6
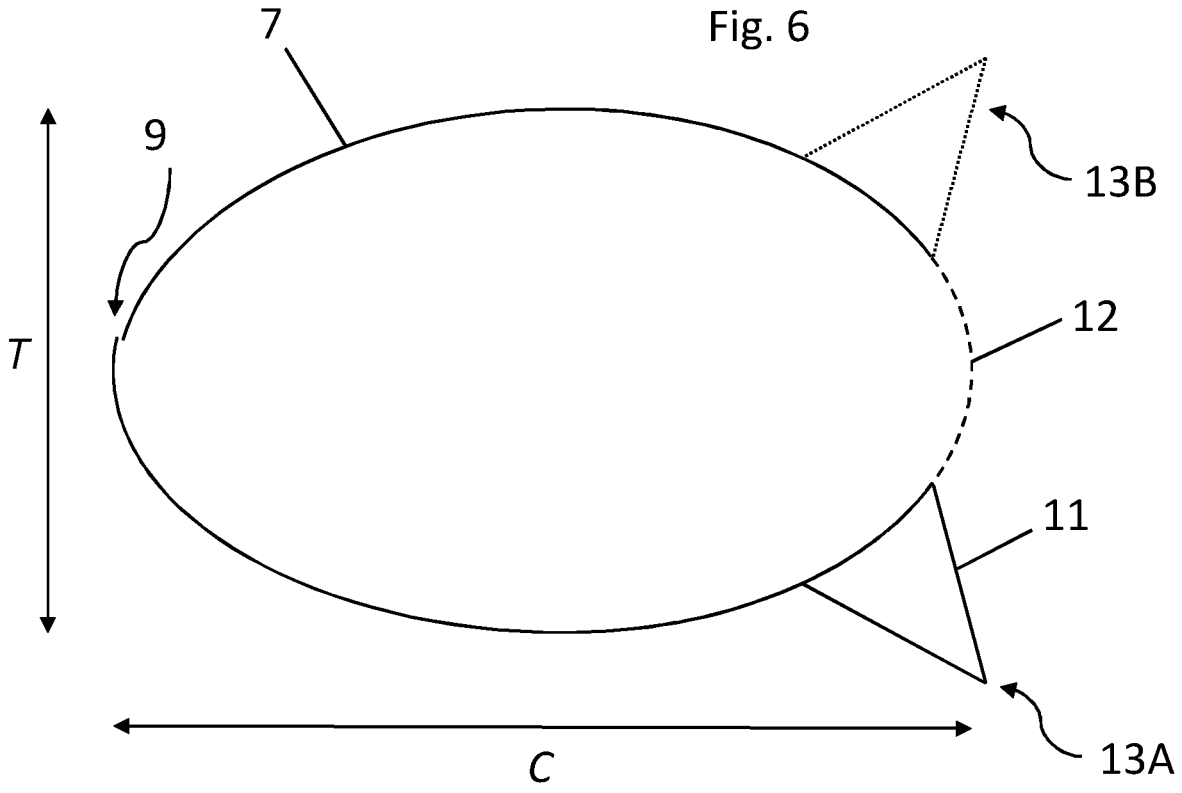
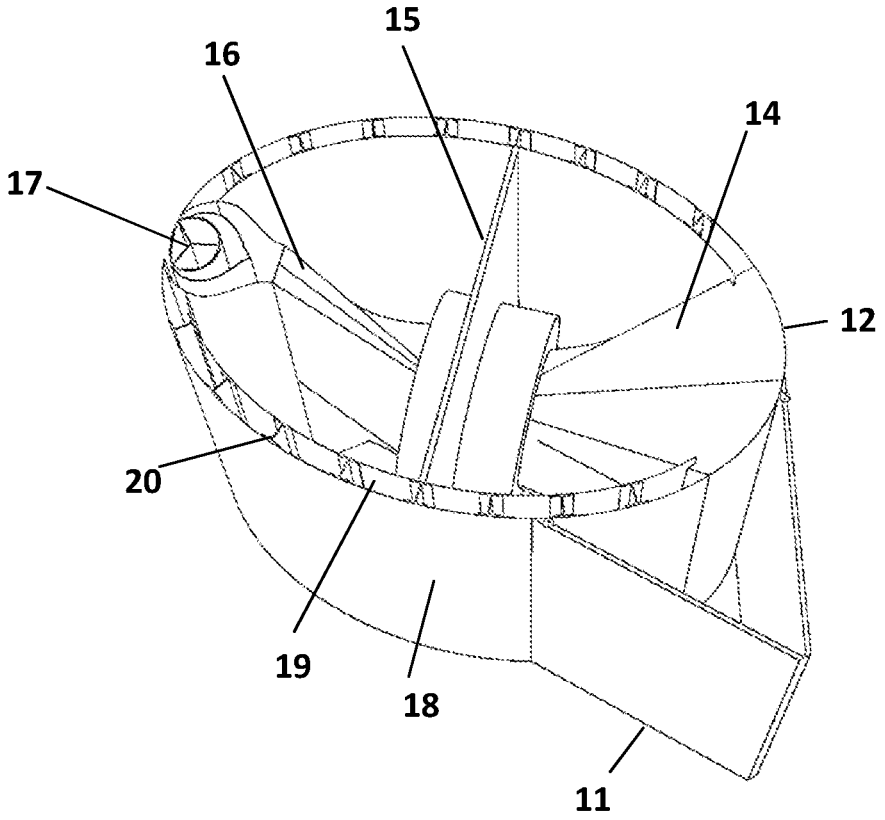
Fig. 7

PROPULSION APPARATUS

This application is the U.S. national phase of International Application No. PCT/GB2018/051311 filed May 15, 2018 which designated the U.S. and claims priority to GB Patent Application No. 1707771.0 filed May 15, 2017, the entire contents of each of which are hereby incorporated by reference.

FIELD OF THE INVENTION

The invention relates to propulsion apparatus for an aquatic vessel.

BACKGROUND TO THE INVENTION

A number of auxiliary propulsive thrust devices have been designed for use on aquatic vessels such as ocean-going ships. Auxiliary propulsive thrust devices provide additional thrust beyond the principal propulsion system (which typically includes a motor or engine driving a propeller or impeller). Examples of auxiliary propulsive thrust devices include conventional sails, Flettner rotors and rigid sails combined with powered boundary layer control systems (such as suction sails).

A conventional sail is a passive device, meaning that the propulsive thrust it generates is typically solely dependent on the instantaneous wind conditions and the sail parameters (e.g. surface area, shape and orientation). In contrast, Flettner rotors and rigid sails incorporating powered boundary layer control systems (such as suction sails) are active devices which require a source of power (such as a ship's engine secondary power system). A Flettner rotor typically consists of an elongate, rigid and vertically-oriented cylinder which is rotated rapidly about its longitudinal axis. The Flettner rotor generates a propulsive force by virtue of the Magnus effect; any spinning body located in a moving airstream experiences a lift force which acts perpendicularly to the direction of the airstream (as well as a drag component in the direction of the airstream). A rigid sail typically consists of a stationary, vertically-oriented elongate body. In suction sails, an air inlet is provided towards the trailing edge of the elongate body and an aspiration system is used to pull air into the body through the inlet, increasing attachment of the boundary layer to the external surface of the sail. The use of Flettner rotors or powered sails typically increases a ship's efficiency. However, the auxiliary propulsive forces achievable using suction sails are relatively low and so few ships make use of such devices. Flettner sails generally have a complex construction, are difficult to retrofit to existing ships and are consequently expensive. Flettner sails also generate a large amount of drag in addition to lift.

Accordingly, it would be beneficial to provide active auxiliary propulsive thrust devices for use on aquatic vessels which are capable of producing significantly larger propulsive forces. It would also be beneficial to provide active auxiliary propulsive thrust devices which can be installed (e.g. retrofitted) easily.

SUMMARY OF THE INVENTION

A first aspect of the invention provides propulsion apparatus for an aquatic vessel. The propulsion apparatus typically comprises an aerodynamic body which extends along a longitudinal axis between first and second ends. The aerodynamic body typically further extends in a transverse direction between a leading edge and trailing edge. The aerodynamic body typically has one or more external wind-receiving surfaces which extend between the leading edge and the trailing edge. The one or more external wind-receiving surfaces typically define an aerodynamic profile of the aerodynamic body in cross-section (i.e. substantially) perpendicular to the longitudinal axis.

It will be understood that an aquatic vessel is a vessel configured for transportation on water (such as an ocean, sea, river or lake), that is to say that an aquatic vessel is a form of watercraft. The aquatic vessel may be a marine vessel, that is to say an aquatic vessel configured for transportation on the sea. The aquatic vessel may be a ship or a boat.

The aerodynamic body is typically mountable or mounted to the aquatic vessel. It may be that the first end of the aerodynamic body is mountable or mounted to the aquatic vessel. The aerodynamic body (e.g. the first end of the aerodynamic body) may be mountable or mounted to an upper surface of the aquatic vessel (e.g. the deck). The aerodynamic body (e.g. the first end of the aerodynamic body) may be mountable or mounted to the aquatic vessel such that, when the aerodynamic body is mounted to the aquatic vessel, the aerodynamic body extends (i.e. substantially) vertically away from the said aquatic vessel (i.e. when the aquatic vessel is upright such that, for example, any decks are (i.e. substantially) horizontal).

The aerodynamic body is mountable or mounted to the aquatic vessel such that the aerodynamic body is orientable (i.e. with respect to the aquatic vessel) when it is mounted to the aquatic vessel (i.e. the orientation of the aerodynamic body with respect to the aquatic vessel may be changed). The orientation of the aerodynamic body is therefore not typically (i.e. permanently) fixed when the aerodynamic body is mounted to the aquatic vessel. Instead, the aerodynamic body may be releasably retainable in more different orientations.

The aerodynamic body may be (i.e. substantially) elongate. The aerodynamic body may be (i.e. substantially) elongate along the longitudinal axis.

The aerodynamic body may be rotatably mountable or mounted to the aquatic vessel such that the said aerodynamic body is rotatable about the longitudinal axis (or about an axis parallel to the longitudinal axis) when the aerodynamic body is mounted to the aquatic vessel.

The transverse direction is typically (i.e. substantially) perpendicular to the longitudinal axis. The leading edge may extend (i.e. substantially) parallel to the longitudinal axis. The trailing edge may extend (i.e. substantially) parallel to the longitudinal axis.

In use, the aerodynamic body is mounted to (i.e. the exterior of) the aquatic vessel such that air may flow around the aerodynamic body. Flow of air around the aerodynamic body may be due to atmospheric wind and/or movement of the aquatic vessel across the body of water. The aquatic vessel and/or the aerodynamic body are typically positioned and oriented such that, as air flows around the aerodynamic body, air flows over one or more of the one or more wind-receiving surfaces. As air flows over the wind-receiving surfaces, a lift force is exerted on the aerodynamic body. The lift force typically acts in a (i.e. substantially) horizontal direction. A ((i.e. substantially) horizontal) force is thereby exerted on the aquatic vessel, typically causing the aquatic vessel to move (assuming that the aquatic vessel is floating relatively unrestrained on the body of water such that it is free to move under any applied forces). Accordingly, the aerodynamic body functions as a form of sail (i.e. a rigid sail) for the aquatic vessel, although it will be understood that the aerodynamic body is not a conventional sail in the sense that is not formed from one or more panels of flexible fabric attached to a mast.

The aerodynamic body typically functions as a (i.e. vertically oriented) aerofoil. The longitudinal axis of the aerodynamic body typically corresponds to the span of the aerofoil. A straight line connecting the leading and trailing edges along the transverse direction (i.e. substantially perpendicular to the longitudinal axis of the aerodynamic body) typically corresponds to the chord of the aerofoil. A thickness of the aerodynamic body, which may be defined (i.e. substantially) perpendicular to both the longitudinal axis and the transverse direction, typically corresponds to the thickness of the aerofoil.

It may be that the one or more external wind-receiving surfaces comprise at least one suction surface portion and at least one pressure surface portion. For example, it may be that the aerodynamic body comprises a single external wind-receiving surface comprising at least one suction surface portion and at least one pressure surface portion.

It may be that the aerodynamic body comprises at least two external wind-receiving surfaces (e.g. extending between the leading edge and the trailing edge). For example, the aerodynamic body may comprise a first external wind-receiving surface and a second external wind-receiving surface (e.g. both the first and second external wind-receiving surfaces extending between the leading edge and the trailing edge).

It may be that the first external wind-receiving surface comprises at least one suction surface portion. It may be that the first external wind-receiving surface is a suction surface. It may be that the second external wind-receiving surface comprises at least one pressure surface portion. It may be that the second external wind-receiving surface is a pressure surface.

When air (i.e. wind) flows over the suction surface and the pressure surface (and/or the at least one suction surface portion and the at least one pressure surface portion), a pressure gradient is typically generated between said suction surface and said pressure surface (and/or said at least one suction surface portion and said at least one pressure surface portion), resulting in a lift force acting on the aerodynamic body.

The skilled person will understand that by the "leading edge" of the aerodynamic body we refer to the geometrical leading edge of the said aerodynamic body as distinct from the aerodynamic leading edge, and by the "trailing edge" we refer to the geometrical trailing edge of the aerodynamic body as distinct from the aerodynamic trailing edge. The geometrical leading edge is typically the foremost edge of the aerodynamic body (i.e. when mounted on the aquatic vessel in use). That is to say, the geometrical leading edge is typically formed by a line connecting the foremost points of each cross-section through the aerodynamic body (each cross-section being taken perpendicular to the longitudinal axis) along the longitudinal axis. The geometrical trailing edge is typically the rearmost (i.e. the furthest aft) edge of the aerodynamic body (i.e. when mounted on the aquatic vessel in use). That is to say, the geometrical trailing edge is formed by a line connecting the rearmost (i.e. furthest aft) points of each cross-section through the aerodynamic body (each cross-section being taken perpendicular to the longitudinal axis) along the longitudinal axis. The geometrical trailing and leading edges each form part of, or are formed by part of, the structure of the aerodynamic body itself.

In contrast, the aerodynamic leading edge is located at the stagnation point (i.e. the point at which, in use, the local velocity of the approaching airstream is zero) whose location varies with the angle of attack and customisable operating parameters. The aerodynamic trailing edge is located at a point at which flows of air across suction and pressure surfaces of the aerodynamic body reconnect. The location of the aerodynamic trailing edge again varies with the angle of attack and customisable operating parameters. Accordingly, in use, air typically flows around the aerodynamic body in two different directions from the aerodynamic leading edge towards the aerodynamic trailing edge.

The aerodynamic body typically has a transverse axis which extends along the transverse direction (i.e. perpendicular to the longitudinal axis), the (i.e. geometrical) leading edge and the (i.e. geometrical) trailing edge being located at opposing ends of the transverse axis. The aerodynamic body typically extends along the transverse axis between the (i.e. geometrical) leading edge and the opposing the (i.e. geometrical) trailing edge.

The aerodynamic body may be elongate in cross-section perpendicular to the longitudinal axis. The elongate aerodynamic body may extend along the transverse axis between the (i.e. geometrical) leading edge and the (i.e. geometrical) trailing edge, that is to say that the (i.e. geometrical) leading edge and the (i.e. geometrical) trailing edge may be located at opposing ends of the elongate cross-section of the aerodynamic body.

The transverse axis may be an axis of symmetry of the aerodynamic body (i.e. an axis of symmetry of the cross-section of the aerodynamic body), that is to say that the (i.e. local) profile of the aerodynamic body may be symmetric about the transverse axis, the (i.e. geometrical) leading edge and the (i.e. geometrical) trailing edge being located at opposing ends of said axis of symmetry.

The transverse axis may extend along the chord of the aerodynamic body, the (i.e. geometrical) leading edge and the (i.e. geometrical) trailing edge being located at opposing ends of the chord.

The aerodynamic profile (e.g. the aerodynamic profile in cross-section at a given location along the length of the aerodynamic body) may be symmetric. The aerodynamic profile may be symmetric about an axis of symmetry which extends (i.e. substantially) perpendicular to the longitudinal axis. The aerodynamic profile may be symmetric about an axis of symmetry which extends in the transverse direction. The aerodynamic profile may be symmetric about an axis of symmetry which extends along a straight line between the (i.e. geometrical) leading edge and the (i.e. geometrical) trailing edge.

The aerodynamic body (e.g. the shape of the aerodynamic body, for example the external shape of the aerodynamic body) may be symmetric. The aerodynamic body may be symmetric across a mirror plane which extends along the longitudinal axis. The aerodynamic body may be symmetric across a mirror plane defined by the longitudinal axis and the transverse direction. The aerodynamic body may be symmetric across a mirror plane defined by the longitudinal axis and a straight line which extends between the (i.e. geometrical) leading edge and the (i.e. geometrical) trailing edge.

Symmetry of the aerodynamic body typically means that the propulsion apparatus can take advantage of wind approaching the aerodynamic body from either side of the aquatic vessel in use.

The aerodynamic profile is typically rounded. The aerodynamic profile is typically aerofoil-shaped, that is to say it is typically streamlined in shape. The aerodynamic profile may be arcuate (i.e. arc-shaped). The aerodynamic profile may be (i.e. substantially) elliptical in shape. The aerodynamic profile may comprise one or more arcuate (i.e. arc-shaped) portions. The aerodynamic profile may comprise one or more (i.e. substantially) elliptical portions, that is to say one or more portions of the aerodynamic profile may be formed from portions of an ellipse. The aerodynamic profile may comprise one or more circular portions, that is to say one or more portions of the aerodynamic profile may be formed from one or more portions of a circle. However, it may be that the aerodynamic profile is non-circular along at least the majority, or all, of the length of the aerodynamic profile.

The aerodynamic body may be cambered in cross-section perpendicular to the longitudinal axis. The aerodynamic profile (e.g. the aerodynamic profile in cross-section, perpendicular to the longitudinal axis, at a given location along the length of the aerodynamic body) may be cambered. That is to say, the aerodynamic profile may be asymmetric in cross-section perpendicular to the longitudinal axis. The aerodynamic profile may comprise first and second cambered profile portions either side of a camber line. The camber line is a line equidistant from the first and second cambered profile portions. The (i.e. geometrical) leading edge and the (i.e. geometrical) trailing edge may be located at opposing ends of the camber line.

The aerodynamic body typically comprises a leading region and a trailing region. The leading region is typically a region of the aerodynamic body proximate the (i.e. geometrical) leading edge. The leading region typically comprises the (i.e. geometrical) leading edge. The leading region typically extends away from the (i.e. geometrical) leading edge (i.e. towards the trailing edge) along at least 10%, or at least 20%, or at least 30%, or at least 40% of the chord. The trailing region is typically a region of the aerodynamic body proximate the (i.e. geometrical) trailing edge. The trailing region typically comprises the (i.e. geometrical) trailing edge. The trailing region typically extends away from the (i.e. geometrical) trailing edge (i.e. towards the leading edge) along at least 10%, or at least 20%, or at least 30%, or at least 40% of the chord.

The aerodynamic profile may comprise a leading edge portion and a trailing edge portion. The leading edge portion is typically a portion of the aerodynamic profile comprising (e.g. intersecting) a portion of the (i.e. geometrical) leading edge. The trailing edge portion is typically a portion of the aerodynamic profile comprising (e.g. intersecting) a portion of the (i.e. geometrical) trailing edge. The leading edge portion may comprise a portion of the leading region of the aerodynamic body. The trailing edge portion may comprise a portion of the trailing region of the aerodynamic body.

It may be that the thickness of the leading edge portion increases from the (i.e. geometrical) leading edge towards the (i.e. geometrical) trailing edge. It may be that thickness of the trailing edge portion increases from the (i.e. geometrical) trailing edge towards the (i.e. geometrical) leading edge.

It may be that the leading edge portion of the aerodynamic profile is arcuate (i.e. arc-shaped). It may be that the leading edge portion of the aerodynamic profile is (i.e. substantially) elliptical (that is to say formed from a portion of an ellipse). It may be that the leading edge portion of the aerodynamic profile is (i.e. substantially) circular (that is to say formed from a portion of a circle).

It may be that the trailing edge portion of the aerodynamic profile is arcuate (i.e. arc-shaped). It may be that the trailing edge portion of the aerodynamic profile is (i.e. substantially) elliptical (that is to say formed from a portion of an ellipse). It may be that the trailing edge portion of the aerodynamic profile is (i.e. substantially) circular (that is to say formed from a portion of a circle).

It may be that the aerodynamic profile is constant along the length of the aerodynamic body (i.e. the shape of the aerodynamic profile is constant along the length of the aerodynamic body, that is to say the cross-sectional shape of the aerodynamic body is constant along the length of the aerodynamic body). Alternatively, it may be that the aerodynamic profile is not constant along the length of the aerodynamic body (i.e. the shape of the aerodynamic profile is not constant along the length of the aerodynamic body, that is to say the cross-sectional shape of the aerodynamic body is not constant along the length of the aerodynamic body). It may be that the aerodynamic profile varies along the length of the aerodynamic body (i.e. the shape of the aerodynamic profile varies along the length of the aerodynamic body, that is to say the cross-sectional shape of the aerodynamic body varies along the length of the aerodynamic body).

It may be that the aerodynamic profile is constant along at the majority of the length of the aerodynamic body. It may be that the aerodynamic profile is constant along at least 40%, at least 50%, at least 60%, at least 70%, at least 80%, or at least 90%, of the length of the aerodynamic body.

It may be that the aerodynamic profile is defined (i.e. at least in part) by one continuous external wind-receiving surface of the aerodynamic body (i.e. the perimeter of the aerodynamic profile is formed by the said one continuous external wind-receiving surface). It may be that the aerodynamic profile is defined (i.e. at least in part) by two external wind-receiving surfaces of the aerodynamic body (i.e. the perimeter of the aerodynamic profile is formed by the said two external wind-receiving surfaces). It may be that the aerodynamic profile is defined (i.e. at least in part) by three or more external wind-receiving surfaces of the aerodynamic body (i.e. the perimeter of the aerodynamic profile is formed by the said three or more external wind-receiving surfaces).

It may be that the (e.g. perimeter of) the aerodynamic profile is continuous around a majority of the said profile (e.g. around at least 60%, or around at least 70%, or around at least 80%, or around at least 90% of the said profile, for example around the entire profile). It may be that the curvature of the (e.g. perimeter of) the aerodynamic profile varies continuously around a majority of the said profile (e.g. around at least 60%, or around at least 70%, or around at least 80%, or around at least 90% of the said profile, for example around the entire profile).

It may be the (e.g. perimeter of) the aerodynamic profile is (i.e. substantially) convex. It may be that the (e.g. perimeter of) the aerodynamic profile is (i.e. substantially) convex around a majority of the said profile (e.g. around at least 60%, or around at least 70%, or around at least 80%, or around at least 90% of the said profile, for example around the entire profile).

The propulsion apparatus may comprise at least one air vent. Accordingly, the invention may extend to propulsion apparatus for an aquatic vessel, the propulsion apparatus comprising an aerodynamic body which extends along a longitudinal axis between first and second ends, the aerodynamic body extending in a transverse direction between a (i.e. geometrical) leading edge and (i.e. geometrical) trailing edge, the aerodynamic body having one or more external wind-receiving surfaces which extend between the (i.e. geometrical) leading edge and the (i.e. geometrical) trailing edge, the one or more external wind-receiving surfaces defining an aerodynamic profile of the aerodynamic body in cross-section (i.e. substantially) perpendicular to the longitudinal axis, the propulsion apparatus further comprising at least one air vent.

It may be that the aerodynamic body comprises the at least one air vent. It may be that the at least one air vent is provided through (i.e. at least a portion of) the aerodynamic body. It may be that the at least one air vent is provided through (i.e. at least a portion of) an external surface (e.g. an external wind-receiving surface) of the aerodynamic body. It may be that the at least one air vent is provided in the external surface (e.g. the external wind-receiving surface) of the aerodynamic body. It may be that the at least one air vent is provided between two external wind-receiving surfaces of the aerodynamic body, for example at an interface between said two external wind-receiving surfaces.

The propulsion apparatus may comprise at least one air flow generator.

The at least one air flow generator may be configured to (i.e. in use) expel air through the at least one air vent.

The at least one air flow generator and/or the at least one air vent may be configured to (i.e. in use) direct expelled air around (i.e. at least a portion of) the aerodynamic body. The at least one air flow generator and/or the at least one air vent may be configured to (i.e. in use) direct expelled air around (i.e. at least a portion of) one or more external wind-receiving surfaces of the aerodynamic body. The at least one air flow generator and/or the at least one air vent may be configured to (i.e. in use) direct expelled air around (i.e. at least a portion of) the exterior of the aerodynamic body. The at least one air flow generator and/or the at least one air vent may be configured to (i.e. in use) direct expelled air (i.e. substantially) tangential to (i.e. air is expelled in a direction (i.e. substantially) tangential to) the one or more external wind-receiving surfaces and/or the exterior of the aerodynamic body (i.e. immediately adjacent to the at least one vent). The at least one air flow generator and/or the at least one air vent may be configured to (i.e. in use) direct expelled air across (e.g. around and/or (i.e. substantially) tangential to) the suction surface and/or the suction surface portion. The at least one air flow generator and/or the at least one air vent may be configured to (i.e. in use) direct expelled air away from the aerodynamic leading edge. The at least one air flow generator and/or the at least one air vent may be configured to (i.e. in use) direct expelled air towards the aerodynamic trailing edge.

In use, an aerodynamic suction region of the aerodynamic body typically extends from the aerodynamic leading edge to the aerodynamic trailing edge. The aerodynamic suction region is the region of the aerodynamic body around which, in use, air pressure is reduced compared to ambient air pressure and air flow is accelerated compared to the incoming wind velocity. The aerodynamic suction region may extend across (e.g. comprise) at least a portion of the suction surface and/or the suction surface portion and/or the pressure surface and/or the pressure surface portion. The location of the aerodynamic suction region typically depends, in use, on the wind conditions, the angle of attack and/or customisable operating parameters. The at least one air flow generator and/or the at least one air vent may be configured to (i.e. in use) direct expelled air across (e.g. around and/or (i.e. substantially) tangential to) (i.e. at least a portion of) the aerodynamic suction region of the aerodynamic body.

A jet of air directed (i.e. at least substantially) at a tangent to an adjacent curved surface tends to remain attached to that surface and therefore to follow the curvature of the surface (this is known as the Coandă effect). Accordingly, air expelled through the at least one vent typically flows (i.e. at least initially) across and remains attached to the one or more external wind-receiving surfaces and/or the exterior of the aerodynamic body. Attached air flowing across a curved surface also typically entrains neighbouring sheets of air into the flow. Accordingly, expelling air through the at least one vent typically modifies (e.g. increases) the upwash angle (i.e. the angle of deflection of the incoming air flow), increasing lift. The stagnation point is typically moved further away from the (i.e. geometrical) leading edge of the aerodynamic body towards the (i.e. geometrical) trailing edge of the said aerodynamic body by expelling air through the at least one vent, thereby increasing a length of the aerodynamic suction region and decreasing a length of an opposing aerodynamic pressure region.

In use, as air (i.e. wind) flows across the one or more external wind-receiving surfaces from the aerodynamic leading edge towards the aerodynamic trailing edge, air expelled through the at least one air vent which flows across the one or more external wind-receiving surfaces joins the air (i.e. wind) already flowing thereacross (i.e. the boundary layer) and increases the velocity of the said air flowing thereacross. As the velocity of the air flowing across the one or more external wind-receiving surfaces increases, air typically travels a greater distance across the one or more wind-receiving surfaces before the flow detaches from the said one or more surfaces. Expelling air through the at least one vent therefore typically results in displacement of the point of air flow detachment away from the (i.e. geometrical) leading edge and towards the (i.e. geometrical) trailing edge (i.e. in the transverse direction). Expelling air through the at least one vent may even result in displacement of the point of air flow detachment beyond the (i.e. geometrical) trailing edge. Accordingly, attached air flows over a greater area of external wind-receiving surface, increasing the lift coefficient of the aerodynamic body and consequently increasing the lift force exerted on the aerodynamic body by the flow of air.

The at least one air vent may be located in the leading region of the aerodynamic body. The at least one air vent may be located at and/or adjacent to the (i.e. geometrical) leading edge. The at least one air vent may be located within a distance from the (i.e. geometrical) leading edge which is less than 40%, or less than 30%, or less than 20%, or less than 10%, of the straight line distance between the (i.e. geometrical) leading edge and the (i.e. geometrical) trailing edge (i.e. along the chord).

The at least one air vent typically comprises at least one air vent aperture through which air may be expelled.

The at least one air vent aperture may be (i.e. substantially) elongate (i.e. the at least one air vent aperture may be at least one elongate vent aperture). The at least one air vent aperture may extend (i.e. substantially) parallel to the (i.e. geometrical) leading edge. The at least one air vent aperture may extend along the (i.e. geometrical) leading edge.

The at least one air vent may comprise two or more air vent apertures. The two or more air vent apertures may be (i.e. substantially) elongate. The two or more air vent apertures may extend (i.e. substantially) parallel to the (i.e. geometrical) leading edge. The two or more air vent apertures may extend along the (i.e. geometrical) leading edge.

The propulsion apparatus may comprise two or more air vents. The two or more air vents may be located in the leading region of the aerodynamic body. The two or more air vents may be located at and/or adjacent to the (i.e. geometrical) leading edge. The two or more air vents may be spaced apart (i.e. from each other) along the (i.e. geometrical) leading edge.

The propulsion apparatus may comprise a plurality of air vents. The propulsion apparatus may comprise at least three air vents. The propulsion apparatus may comprise at least five air vents. The propulsion apparatus may comprise at least ten air vents. Each of the at least three, at least five or at least ten air vents may be located in the leading region of the aerodynamic body. Each of the at least three, at least five or at least ten air vents may be located at and/or adjacent to the leading edge. Each of the at least three, at least five or at least ten air vents may be spaced apart (i.e. from one another) along the leading edge.

The at least one air flow generator and/or the at least one air vent may be configured to expel air out of the aerodynamic body. The at least one air flow generator and/or the at least one air vent may be configured to expel air out of an interior (e.g. an interior portion) of the aerodynamic body. The at least one air flow generator and/or the at least one air vent may be configured to expel air from within the aerodynamic body to outside the aerodynamic body.

The at least one air flow generator may be located within (i.e. inside) the (e.g. interior portion) of the aerodynamic body. The aerodynamic body may be substantially hollow. The at least one air flow generator may be located within a substantially hollow interior of the aerodynamic body. The at least one air flow generator may be configured to drive a flow of air out of the (e.g. interior portion or substantially hollow interior of) the aerodynamic body and through the at least one air vent.

The at least one air flow generator typically comprises at least one air displacement machine. The at least one air flow generator may comprise (e.g. consist of) a fan. Additionally or alternatively, the at least one air flow generator may comprise (e.g. consist of) a pump. By a pump, it will be understood that we mean a positive air displacement machine.

The at least one air flow generator may be arranged (i.e. substantially) vertically. The at least one air flow generator may be arranged (i.e. substantially) perpendicular to the transverse direction. For example, in the case of a fan, the fan may be arranged (i.e. positioned and oriented) such that the blades of the fan rotate in a plane substantially perpendicular to the transverse direction (i.e. a plane containing both the longitudinal axis of the aerodynamic body and the thickness). Alternatively, the fan may be arranged (i.e. positioned and oriented) such that the blades of the fan rotate in a plane containing the longitudinal axis of the aerodynamic body but not the thickness. For example, the fan may be inclined with respect to the thickness of the aerodynamic body and/or the transverse direction.

The at least one air flow generator may be arranged (i.e. substantially) horizontally. For example, in the case of a fan, the fan may be arranged (i.e. positioned and oriented) such that the blades of the fan rotate in a plane substantially perpendicular to the longitudinal direction (i.e. a plane containing both the transverse direction and the thickness).

The at least one air flow generator may comprise an air compressor. The air compressor may be arranged (i.e. substantially) horizontally.

The propulsion apparatus may comprise a plurality of air flow generators. The plurality of air flow generators may be arranged (e.g. periodically) to form an array.

The at least one air flow generator (e.g. the plurality of air flow generators) may comprise (e.g. consist of) a plurality of fans and/or pumps and/or air compressors. The plurality of fans and/or pumps and/or air compressors may be arranged (e.g. periodically) to form an array.

The propulsion apparatus may comprise one or more channels (e.g. ducts) provided between the at least one air flow generator and the at least one air vent. The one or more channels (e.g. ducts) may be located within (i.e. inside) the (e.g. interior portion) of the aerodynamic body. The one or more channels (e.g. ducts) may be located within the substantially hollow interior of the aerodynamic body. The one or more channels (e.g. ducts) may connect the at least one air flow generator to the at least one vent. The one or more channels (e.g. ducts) are typically configured to guide air from the at least one air flow generator towards (i.e. and subsequently through) the at least one vent.

A cross-sectional flow area of one or more of the one or more channels (i.e. a cross-sectional area of the interior of the one or more channels through which air flows in use from the at least air flow generator towards the at least one vent, the cross-sectional area measured in a plane perpendicular to the principal direction of air flow through the said one or more channels) may vary along a length of the said one or more channels. It may be that the cross-sectional flow area of one or more of the one or more channels decreases along the length of the said one or more channels from the at least one air flow generator towards the at least one vent, that is to say that one or more of the one or more channels may narrow along the length of the said one or more channels from the at least one air flow generator towards the at least one vent. Narrowing of the one or more channels towards the at least one vent typically causes, in use, an increase in the velocity of air being expelled through the at least one vent. The greater the velocity of air expelled through the at least one vent, the further air typically travels across the one or more external wind-receiving surfaces before detaching from the said surfaces, and the greater the lift which can be generated.

The one or more channels may narrow in a first direction towards the at least one vent. The one or more channels may expand in a second direction perpendicular to the first direction towards the at least one vent. For example, the one or more channels may narrow in a direction parallel to the thickness of the aerodynamic body and expand in a direction parallel to the longitudinal axis of the aerodynamic body.

The propulsion apparatus may comprise at least one air vent flow regulator. The at least one air vent flow regulator is typically configured to regulate the speed and/or direction of flow of air through the at least one vent (i.e. the speed and/or direction of air expelled through the at least one vent).

The at least one air vent flow regulator may comprise (e.g. consist of) an air flow guide. The air flow guide may be configured to regulate the direction of flow of air through the at least one vent (i.e. the direction of flow of air expelled through the at least one vent).

The air flow guide may be adjustable. The air flow guide may be (i.e. at least partially) movable. The air flow guide may comprise a movable wall. The air flow guide may be (i.e. at least partially) rotatable. The air flow guide may comprise a rotatable wall. Adjustment (e.g. movement and/or rotation) of the air flow guide (or the movable and/or rotatable wall) typically causes the direction in which air flows through the at least one vent (i.e. the direction of flow of air expelled through the at least one vent) to change.

The air flow guide (e.g. the movable and/or rotatable wall) may be movable and/or rotatable between at least first and second positions, wherein, when the air flow guide (or wall) is provided in the first position, (i.e. in use) air is expelled through the at least one vent in a first flow direction such that air flows around at least a first portion of the exterior of the aerodynamic body in a first sense, and wherein, when the air flow guide (or wall) is provided in the second position, air is expelled through the at least one vent in a second flow direction such that air flows around at least a second portion of the exterior of the aerodynamic body in a second sense opposite said first sense. For example, when viewed from a fixed point of reference (e.g. from the first end of the aerodynamic body), it may be that, when the air flow guide (or wall) is provided in the first position, air is expelled through the at least one vent in a first flow direction such that air flows clockwise around the exterior of the aerodynamic body, and, when the air flow guide (or wall) is provided in the second position, air is expelled through the at least one vent in a second flow direction such that air flows anti-clockwise (i.e. counter-clockwise) around the exterior of the aerodynamic body.

The propulsion apparatus may comprise at least one air intake. Accordingly, the invention may extend to propulsion apparatus for an aquatic vessel, the propulsion apparatus comprising an aerodynamic body which extends along a longitudinal axis between first and second ends, the aerodynamic body extending in a transverse direction between a (i.e. geometrical) leading edge and (i.e. geometrical) trailing edge, the aerodynamic body having one or more external wind-receiving surfaces which extend between the (i.e. geometrical) leading edge and the (i.e. geometrical) trailing edge, the one or more external wind-receiving surfaces defining an aerodynamic profile of the aerodynamic body in cross-section (i.e. substantially) perpendicular to the longitudinal axis, the propulsion apparatus further comprising at least one air intake.

It may be that the aerodynamic body comprises the at least one air intake. It may be that the at least one air intake is provided through (i.e. at least a portion of) the aerodynamic body. It may be that the at least one air intake is provided through (i.e. at least a portion of) an external surface (e.g. an external wind-receiving surface) of the aerodynamic body. It may be that the at least one air intake is provided between two external wind-receiving surfaces of the aerodynamic body, for example at an interface between the two said surfaces.

The at least one air flow generator may be configured to draw (i.e. suck or aspirate) air through the at least one air intake.

The at least one air flow generator and/or the at least one air intake may be configured such that (i.e. in use) air is drawn through the at least one intake from outside the aerodynamic body. The at least one air flow generator and/or the at least one air intake may be configured such that (i.e. in use) air is drawn through the at least one intake from air flowing around the aerodynamic body. The at least one air flow generator and/or the at least one air intake may be configured such that (i.e. in use) air is drawn through the at least one intake from air flowing over at least a portion of the one or more external wind-receiving surfaces of the aerodynamic body. The at least one air flow generator and/or the at least one air intake may be configured such that (i.e. in use) air is drawn through the at least one intake from air which is attached to at least a portion of the one or more external wind-receiving surfaces.

The at least one air flow generator and/or the at least one air intake may be configured such that (i.e. in use) air is drawn into the (e.g. substantially hollow) interior of the aerodynamic body through the at least one air intake. That is to say, the at least one air flow generator and/or the at least one air intake may be configured such that (i.e. in use) air is drawn from outside the aerodynamic body, through the at least one air intake, and into the (e.g. substantially hollow) interior of the aerodynamic body.

The at least one air intake may be located at and/or adjacent to the (i.e. geometrical) trailing edge. The at least one air intake may extend across the (i.e. geometrical) trailing edge. If the at least one air intake is not present, a flow of air attached to one or more external wind-receiving surfaces (i.e. attached air flowing from the (i.e. geometrical) leading edge towards the (i.e. geometrical) trailing edge, that is to say the boundary layer flow) typically detaches from the said one or more external wind-receiving surfaces before reaching the (i.e. geometrical) trailing edge. By drawing air from this boundary layer flow through the at least one air intake, the flow of air typically remains attached to the one or more external wind-receiving surfaces over longer distances. The point of detachment of air flow is therefore typically displaced away from the (i.e. geometrical) leading edge towards the (i.e. geometrical) trailing edge (i.e. in the transverse direction). By increasing the distance over which air flow remains attached, the lift coefficient of the aerodynamic body may be increased and thus the amount of lift generated can also be increased. In addition, increasing the distance over which air flow remains attached causes stall to be delayed, that is to say that higher angles of attack are achievable before there is a decrease in the lift coefficient of the aerodynamic body.

The at least one air intake is typically located at and/or extends across the (i.e. geometrical) trailing edge in an operating configuration, i.e. when the propulsion apparatus is in an operating configuration.

It may be that the propulsion apparatus comprises one air intake. The one air intake may be located at the (i.e. geometrical) trailing edge. The one air intake may extend across the (i.e. geometrical) trailing edge. The one air intake may extend across the (i.e. geometrical) trailing edge in an operating configuration, i.e. when the propulsion apparatus is in an operating configuration. The one air intake may be located symmetrically with respect to the (i.e. geometrical) trailing edge, that is to say the one air intake may extend away from the (i.e. geometrical) trailing edge (i.e. substantially) equally in opposing directions around at least a portion of the aerodynamic body.

It may be that the propulsion apparatus comprises more than one air intake. It may be that the propulsion apparatus comprises a first air intake and a second air intake. The first and second air intakes are typically located adjacent to the (i.e. geometrical) trailing edge. For example, it may be that the first and second air intakes are located either side of the (i.e. geometrical) trailing edge. It may be that the first and second air intakes are located symmetrically with respect to the (i.e. geometrical) trailing edge.

The or each air intake may comprise one single air inlet (e.g. one open aperture through which air may be drawn). The or each air intake may comprise two or more air inlets (e.g. two or more open apertures). The or each air intake may comprise a plurality of air inlets (e.g. a plurality of open apertures).

The or each air intake may be perforated. For example, the or each air intake may comprise a perforated portion of the aerodynamic body (i.e. a perforated portion of an external wind-receiving surface of the aerodynamic body). By 'perforated' it will be understood that we mean a portion of the aerodynamic body or wind-receiving surface which comprises a plurality (and typically a large number, for example twenty or more) perforations (i.e. open apertures). The perforations (i.e. open apertures) may be (i.e. substantially) circular in shape. The perforations (i.e. open apertures) may be (i.e. substantially) triangular in shape. The perforations (i.e. open apertures) may be (i.e. substantially) elliptical in shape. The perforations (i.e. open apertures) may be (i.e. substantially) star-shaped. The perforations (i.e. open apertures) may be (i.e. substantially) cross-shaped. The perforations (i.e. open apertures) may be (i.e. substantially) shaped as low-drag air inlets (such as National Advisory Committee for Aeronautics (NACA) inlets).

The or each air intake may be louvred, that is to say the or each air intake may comprise an (e.g. periodic) array of elongate slats and elongate open apertures. Each elongate slat may be (i.e. substantially) rectangular in cross-section. Each elongate slat may have an aerodynamic shape (e.g. an aerodynamic cross-section). For example, each elongate slat may be (i.e. substantially) elliptical in cross-section or may be shaped (i.e. substantially) like an aerofoil. Each elongate open aperture typically has a shape complementary to shape of the elongate slats. For example, each elongate open aperture may be (i.e. substantially) rectangular in shape.

The or each air intake typically has a porosity of at least 20%, or more typically at least 45%. The skilled person will understand that the porosity of the or each air intake is the proportion of the external surface of the said air intake which comprises open aperture (as compared to solid material).

The at least one air flow generator and/or the or each air intake may be configured such that air drawn through the or each air intake is drawn into the aerodynamic body. The at least one air flow generator for drawing air and/or the or each air intake may be configured such that air is drawn into the interior (e.g. the interior portion) of the aerodynamic body. The at least one air flow generator and/or the or each air intake may be configured such that air is drawn into the aerodynamic body from outside the aerodynamic body.

The propulsion apparatus may comprise one or more channels (e.g. ducts) provided between the at least one air flow generator and the or each air intake. The one or more channels (e.g. ducts) may be located within (i.e. inside) the (e.g. interior portion) of the aerodynamic body. The one or more channels (e.g. ducts) may be located within the substantially hollow interior of the aerodynamic body. The one or more channels (e.g. ducts) may connect the at least one air intake to the or one of the at least one air flow generators. The one or more channels (e.g. ducts) are typically configured to guide a flow of air from the or each air intake towards the or one of the at least one air flow generators.

A cross-sectional flow area of one or more of the one or more channels (i.e. a cross-sectional area of the interior of the one or more channels through which air flows in use from the or each air intake towards the or one of the air intake flow generators, the cross-sectional area measured in a plane perpendicular to the principal direction of air flow through the said one or more channels) may vary along a length of the said one or more channels. It may be that the cross-sectional flow area of one or more of the one or more channels decreases along the length of the said one or more channels from the or each air intake towards the or one of the at least one air flow generators, that is to say that one or more of the one or more channels may narrow along the length of the said one or more channels from the or each air intake towards the or one of the at least one air flow generators.

The invention may extend to propulsion apparatus for an aquatic vessel, the propulsion apparatus comprising an aerodynamic body which extends along a longitudinal axis between first and second ends, the aerodynamic body extending in a transverse direction between a (i.e. geometrical) leading edge and a (i.e. geometrical) trailing edge, the aerodynamic body having one or more external wind-receiving surfaces which extend between the (i.e. geometrical) leading edge and the (i.e. geometrical) trailing edge, the one or more external wind-receiving surfaces defining an aerodynamic profile of the aerodynamic body in cross-section (i.e. substantially) perpendicular to the longitudinal axis, the propulsion apparatus further comprising at least one air intake and at least one air vent.

The invention may extend to propulsion apparatus for an aquatic vessel, the propulsion apparatus comprising an aerodynamic body which extends along a longitudinal axis between first and second ends, the aerodynamic body extending in a transverse direction between a (i.e. geometrical) leading edge and a (i.e. geometrical) trailing edge, the aerodynamic body having one or more external wind-receiving surfaces which extend between the (i.e. geometrical) leading edge and the (i.e. geometrical) trailing edge, the one or more external wind-receiving surfaces defining an aerodynamic profile of the aerodynamic body in cross-section (i.e. substantially) perpendicular to the longitudinal axis, the propulsion apparatus further comprising at least one air intake, at least one air vent, and at least one air flow generator configured to draw air through the at least one air intake (i.e. and into the (e.g. interior of) the aerodynamic body) and to expel air (i.e. out of the aerodynamic body) through the at least one air vent.

The propulsion apparatus may further comprise at least one flap. Accordingly, the invention may extend to propulsion apparatus for an aquatic vessel, the propulsion apparatus comprising an aerodynamic body which extends along a longitudinal axis between first and second ends, the aerodynamic body extending in a transverse direction between a (i.e. geometrical) leading edge and a (i.e. geometrical) trailing edge, the aerodynamic body having one or more external wind-receiving surfaces which extend between the (i.e. geometrical) leading edge and the (i.e. geometrical) trailing edge, the one or more external wind-receiving surfaces defining an aerodynamic profile of the aerodynamic body in cross-section (i.e. substantially) perpendicular to the longitudinal axis, the propulsion apparatus further comprising at least one flap.

The at least one flap is typically at least one trailing edge flap. The at least one trailing edge flap is typically located at and/or adjacent to the (i.e. geometrical) trailing edge of the aerodynamic body. The at least one trailing edge flap may be fixedly attached to or integrally formed with the aerodynamic body. Alternatively, the at least one trailing edge flap may be movably coupled to (e.g. mounted to) the aerodynamic body at and/or adjacent to the (i.e. geometrical) trailing edge.

The at least one (e.g. trailing edge) flap typically projects from the aerodynamic body. The at least one (e.g. trailing edge) flap typically projects from the trailing portion of the aerodynamic body.

It may be that the at least one (e.g. trailing edge) flap is movable around (i.e. at least a portion of) the aerodynamic profile of the aerodynamic body. The at least one (e.g. trailing edge) flap may be movable between at least first and second flap positions. It may be that, when in the first flap position, the at least one (e.g. trailing edge) flap is provided to one side of the (i.e. geometrical) trailing edge and, when in the second flap position, the at least one (e.g. trailing edge) flap is provided to an opposing side of the (i.e. geometrical) trailing edge. The at least one (e.g. trailing edge) flap may be continuously movable between the first and second flap positions.

The at least one (e.g. trailing edge) flap may be movable across the at least one air intake. It may be that, when the at least one (e.g. trailing edge) flap is in either the first or the second flap positions, at least a portion of the at least one air intake is covered by at least a portion of the (e.g. trailing edge) flap. Alternatively, it may be that, when the at least one (e.g. trailing edge) flap is in either the first or the second flap positions, the at least one air intake is not covered by the at least one (e.g. trailing edge) flap. It may be that the at least one (e.g. trailing edge) flap is movable (i.e. away from the (i.e. geometrical) trailing edge) beyond the location of the at least one air intake.

It may be that the at least one (e.g. trailing edge flap) is releasably retainable in the first flap position. It may be that the at least one (e.g. trailing edge flap) is releasably retainable in the second flap position.

It may be that the at least one (e.g. trailing edge) flap is movable between a plurality of flap positions. It may be that the at least one (e.g. trailing edge) flap is releasably retainable in two or more of the plurality of flap positions. It may be that the at least one (e.g. trailing edge) flap is continuously movable between the plurality of flap positions.

The at least one (e.g. trailing edge) flap typically comprises one or more external wind-receiving surfaces. The at least one (e.g. trailing edge) flap is typically configured (e.g. shaped) such that, when the said (e.g. trailing edge) flap is in the first or the second flap position, at least a portion of at least one external wind-receiving surface of the said (e.g. trailing edge) flap extends (i.e. substantially) tangentially away from one or more of the external wind-receiving surfaces of the aerodynamic body. The at least one (e.g. trailing edge) flap is typically configured (e.g. shaped) such that, when the said (e.g. trailing edge) flap is in the first or the second flap position, at least a portion of at least one external wind-receiving surface of the said (e.g. trailing edge) flap extends (i.e. substantially) tangentially away from said external wind-receiving surface. For example, it may be that the at least one (e.g. trailing edge) flap is typically configured (e.g. shaped) such that, when the said (e.g. trailing edge) flap is in the first or the second flap position, at least a portion of at least one external wind-receiving surface of the said (e.g. trailing edge) flap which is proximate (e.g. which contacts) at least one of the external wind-receiving surfaces of the aerodynamic body extends (i.e. substantially) tangentially away from said external wind-receiving surface. It may be that at least one external wind-receiving surface of the (e.g. trailing edge) flap meets at least one external wind-receiving surface of the aerodynamic body tangentially. Accordingly, air flow typically remains attached as it flows onto the flap (i.e. air flows continuously across the junction between the aerodynamic body and the flap), avoiding the formation of macroscopic vortices in the flow (such as Von Karman vortex shedding). The flap therefore provides a larger surface area of external surface over which attached air may flow, increasing the lift coefficient of the aerodynamic body and consequently the lift force generated in use. The flap may also alter (e.g. increase) the camber of the aerodynamic profile, modifying (e.g. increasing) the downwash angle and therefore increasing the lift coefficient of the aerodynamic body.

The at least one (e.g. trailing edge) flap may have a rectangular cross-section (i.e. the at least one (e.g. trailing edge) flap may have a rectangular shape in cross-section in a plane (i.e. substantially) perpendicular to the longitudinal axis of the aerodynamic body). The at least one (e.g. trailing edge) flap may have a rounded cross-section (i.e. the at least one (e.g. trailing edge) flap may have a rounded shape in cross-section in a plane (i.e. substantially) perpendicular to the longitudinal axis of the aerodynamic body). The at least one (e.g. trailing edge) flap may be shaped like an aerofoil in cross-section (i.e. the at least one (e.g. trailing edge) flap may have an aerofoil shape in cross-section in a plane (i.e. substantially) perpendicular to the longitudinal axis of the aerodynamic body). The at least one (e.g. trailing edge) flap may have a triangular cross-section (i.e. the at least one (e.g. trailing edge) flap may have a triangular shape in cross-section in a plane (i.e. substantially) perpendicular to the longitudinal axis of the aerodynamic body). The at least one (e.g. trailing edge) flap may have a trapezoidal (for example the shape of an isosceles trapezoid) cross-section (i.e. the at least one (e.g. trailing edge) flap may have a trapezoidal shape in cross-section in a plane (i.e. substantially) perpendicular to the longitudinal axis of the aerodynamic body). The inventors have found that a trapezoidal shape is particularly effective at reducing the production of vortices as air detaches from the flap.

One or more of the external wind-receiving surfaces of the at least one (e.g. trailing edge) flap may be (i.e. substantially) flat. Additionally or alternatively, one or more of the external wind-receiving surfaces of the at least one (e.g. trailing edge) flap may be (i.e. substantially) curved. Additionally or alternatively, one or more of the external wind-receiving surfaces of the at least one (e.g. trailing edge) flap may be (i.e. substantially) concave. Additionally or alternatively, one or more of the external wind-receiving surfaces of the at least one (e.g. trailing edge) flap may be (i.e. substantially) convex.

One or more sides of the rectangular and/or triangular and/or trapezoidal cross-sections of the at least one (e.g. trailing edge) flap may be flat. Additionally or alternatively, one or more sides of the rectangular and/or triangular and/or trapezoidal cross-sections of the at least one (e.g. trailing edge) flap may be curved. Additionally or alternatively, one or more sides of the rectangular and/or triangular and/or trapezoidal cross-sections of the at least one (e.g. trailing edge) flap may be concave. Additionally or alternatively, one or more sides of the rectangular and/or triangular and/or trapezoidal cross-sections of the at least one (e.g. trailing edge) flap may be convex.

The at least one (e.g. trailing edge) flap is typically configured (e.g. shaped and positioned) such that the at least one (e.g. trailing edge) flap extends (i.e. substantially) perpendicularly away from the (i.e. local portion of the one or more external wind-receiving surfaces of the) aerodynamic body.

The at least one (e.g. trailing edge) flap may have a central axis. The central axis may be an axis of symmetry of the at least one (e.g. trailing edge) flap. For example, the central axis may be an axis of mirror symmetry of the at least one (e.g. trailing edge) flap, that is to say that the central axis may bisect the at least one (e.g. trailing edge) flap in cross-section perpendicular to the longitudinal axis of the aerodynamic body. The central axis may extend through the centre of mass of the at least one (e.g. trailing edge) flap. The central axis may extend along the shortest distance between a trailing edge of the (e.g. trailing edge) flap (e.g. a point on the at least one (e.g. trailing edge) flap which is furthest from the external wind-receiving surface of the aerodynamic body) and the external wind-receiving surface of the aerodynamic body. The at least one (e.g. trailing edge) flap may be configured (e.g. shaped and positioned) such that the central axis of the at least one (e.g. trailing edge) flap extends (i.e. substantially) perpendicularly away from the (i.e. local portion of the one or more external wind-receiving surfaces of the) aerodynamic body. The at least one (e.g. trailing edge) flap may be configured (e.g. shaped and positioned) such that the central axis of the at least one (e.g. trailing edge) flap extends away from the (i.e. local portion of the one or more external wind-receiving surfaces of the) aerodynamic body at an angle of between 70° and 110°, or between 80° and 100°, or between 85° and 95°.

It may be that the at least one (e.g. trailing edge) flap is movable along (e.g. rotates, in use, around) a substantially circular path and that the central axis of the at least one (e.g. trailing edge) flap extends between the rotational centre of the flap (i.e. the point about which the flap rotates) and the trailing edge of the at least one (e.g. trailing edge) flap.

It may be that the at least one (e.g. trailing edge) flap is movable along (e.g. rotates, in use, around) a substantially elliptical path. It may be that the at least one (e.g. trailing edge) flap is movable along (e.g. rotates, in use, around) a path which corresponds to (e.g. is (i.e. geometrically) similar to or congruent with) a profile of the trailing region of the aerodynamic body in cross-section perpendicular to the longitudinal axis.

It may be that, when the at least one (e.g. trailing edge) flap is in the first position, an angle between the central axis of the at least one (e.g. trailing edge) flap and the transverse direction (i.e. extending between the (i.e. geometrical) leading edge and the (i.e. geometrical) trailing edge of the aerodynamic body (i.e. the chord)) is less than or equal to 60°, or less than or equal to 45°. It may be that, when the at least one (e.g. trailing edge) flap is in the second position, an angle between the central axis of the at least one (e.g. trailing edge) flap and the transverse direction (i.e. extending between the (i.e. geometrical) leading edge and the (i.e. geometrical) trailing edge of the aerodynamic body) is less than or equal to 60°, or less than or equal to 45°.

The at least one (e.g. trailing edge) flap may be movable between at least first and second flap positions. It may be that, when in the first flap position, the at least one (e.g. trailing edge) flap is provided to one side of the (i.e. geometrical) trailing edge and, when in the second flap position, the at least one (e.g. trailing edge) flap is provided to an opposing side of the (i.e. geometrical) trailing edge.

It may be that expelling air through the at least one vent results in displacement of the point of air flow detachment beyond the (i.e. geometrical) leading edge and onto the at least one (e.g. trailing edge) flap. The point of air flow detachment may be displaced towards (e.g. up to) the trailing edge of the (e.g. trailing edge) flap. Accordingly, attached air flows over a greater area of external wind-receiving surface, increasing the lift coefficient of the aerodynamic body and consequently increasing the lift force exerted on the aerodynamic body by the flow of air.

The propulsion apparatus may comprise two or more aerodynamic bodies. Each aerodynamic body may extend along a longitudinal axis between respective first and second ends. Each aerodynamic body may extend in a transverse direction between respective (i.e. geometrical) leading and (i.e. geometrical) trailing edges. Each aerodynamic body may have one or more external wind-receiving surfaces which extend between the (i.e. geometrical) leading edge and the (i.e. geometrical) trailing edge. The one or more external wind-receiving surfaces define an aerodynamic profile of each said aerodynamic body in cross-section (i.e. substantially) perpendicular to the respective longitudinal axis. The propulsion apparatus may therefore be modular.

Accordingly, the invention may extend to modular propulsion apparatus for an aquatic vessel, the propulsion apparatus comprising two or more aerodynamic bodies, each aerodynamic body extending along a longitudinal axis between respective first and second ends, each aerodynamic body further extending in a transverse direction between respective (i.e. geometrical) leading and (i.e. geometrical) trailing edges, each aerodynamic body having one or more external wind-receiving surfaces which extend between the (i.e. geometrical) leading edge and the (i.e. geometrical) trailing edge, wherein the one or more external wind-receiving surfaces define an aerodynamic profile of each said aerodynamic body in cross-section (i.e. substantially) perpendicular to the respective longitudinal axis.

A first of the two or more aerodynamic bodies is typically mountable or mounted to the aquatic vessel. It may be that the first end of the said first of the two or more aerodynamic bodies is mountable or mounted to the aquatic vessel. The said first of the two or more aerodynamic bodies (e.g. the first end of the said first aerodynamic body) may be mountable or mounted to an upper surface of the aquatic vessel. The said first of the two or more aerodynamic bodies (e.g. the first end of the said first aerodynamic body) may be mountable or mounted to the aquatic vessel such that, when the aerodynamic body is mounted to the aquatic vessel, the aerodynamic body extends (i.e. substantially) vertically away from the said aquatic vessel (i.e. when the aquatic vessel is upright such that, for example, any decks are (i.e. substantially) horizontal).

A second of the two or more aerodynamic bodies is typically mountable or mounted to the first of the two or more aerodynamic bodies. It may be that the first end of the said second of the two or more aerodynamic bodies is mountable or mounted to the second end of the first of the two or more aerodynamic bodies. It may be that the first end of the second of the two or more aerodynamic bodies is mountable or mounted to the second end of the first of the two or more aerodynamic bodies such that, when the second aerodynamic body is mounted to the first aerodynamic body and the first aerodynamic body is mounted to the aquatic vessel, the second aerodynamic body extends (i.e. substantially) vertically away from the first aerodynamic body (and, consequently, (i.e. substantially) vertically away from the aquatic vessel).

It may be that the propulsion apparatus comprises a plurality of such aerodynamic bodies (for example, three or more, four or more, five or more, six or more, seven or more, eight or more, nine or more, or ten or more such aerodynamic bodies). It may be that each aerodynamic body is mountable or mounted to one or more of the other aerodynamic bodies. It may be that the aerodynamic bodies are mutually mountable such that the aerodynamic bodies may be mounted to one another to form a connected chain of aerodynamic bodies. For example, it may be that the propulsion apparatus comprises four such aerodynamic bodies, a first of the four aerodynamic bodies being mountable or mounted to the aquatic vessel, a second of the four aerodynamic bodies being mountable or mounted to the first aerodynamic body, a third of the four aerodynamic bodies being mountable or mounted to the second aerodynamic body and a fourth of the four aerodynamic bodies being mountable or mounted to the third aerodynamic body.

Each aerodynamic body may be mountable or mounted to one or more of the other aerodynamic bodies such that, when the aerodynamic bodies are mounted to one another, the longitudinal axes of each said aerodynamic body are substantially collinear.

Each aerodynamic body may be (i.e. substantially) the same as each other aerodynamic body. Each aerodynamic body may be interchangeable. For example, each aerodynamic body may be (i.e. substantially) the same in shape, size and/or material construction. Use of aerodynamic bodies which are (i.e. substantially) the same as each other permits a modular construction wherein individual aerodynamic bodies can easily be removed and replaced to enable repair or to adjust the height of the propulsion apparatus in accordance with changing wind conditions or local height restrictions. Modularity also permits use of simplified production techniques and, for example, cheaper mould production.

Each aerodynamic body may comprise a first end plate and a second end plate, the first end plate being provided at the first end of the aerodynamic body and the second end plate being provided at the second end of the aerodynamic body. It may be that each of the aerodynamic bodies is mountable to each of the other aerodynamic bodies by way of the first and second end plates. For example, it may be that the first end plate of each one of the aerodynamic bodies is mountable to the second end plate of each of the other aerodynamic bodies (for example, by screwing the corresponding first and second end plates together).

It may be that each of the aerodynamic bodies is mountable to each of the other aerodynamic bodies by way of internal stiffening components.

Optional and preferred features of any one aspect of the invention may be features of any other aspect of the invention.

DESCRIPTION OF THE DRAWINGS

An example embodiment of the present invention will now be illustrated with reference to the following Figures in which:

FIG. 6 shows a schematic cross-section through the individual sail module of FIG. 4, the cross-section taken perpendicular to a longitudinal axis of the sail module;

FIG. 7 shows a more detailed internal structure of the individual sail module of FIG. 4 than shown in FIG. 5;

DETAILED DESCRIPTION OF AN EXAMPLE EMBODIMENT

Figure 1:
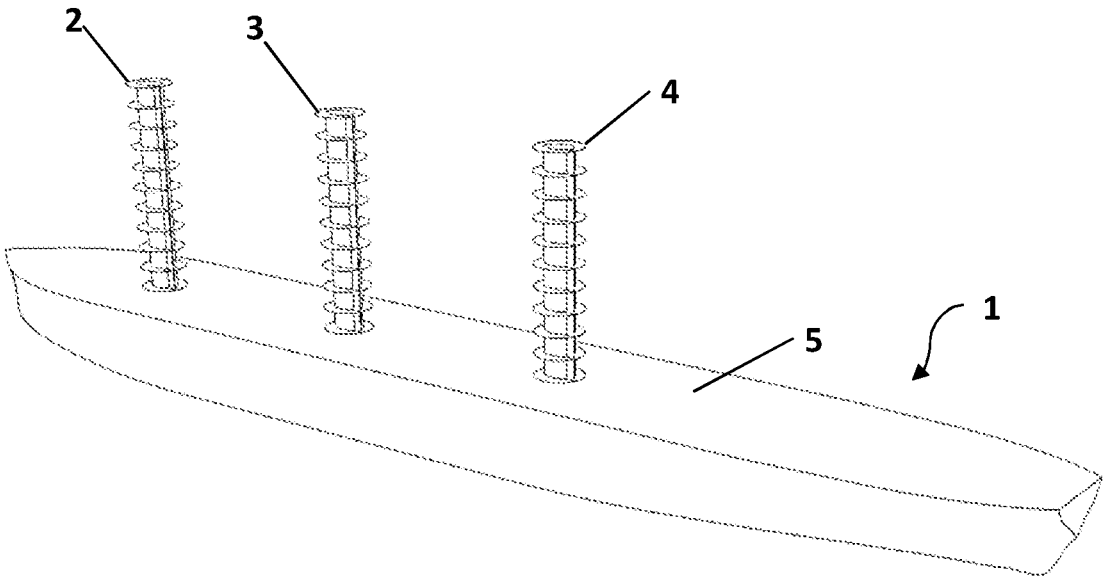
FIG. 1 shows a ship fitted with three rigid, modular sails.
Figure 2:
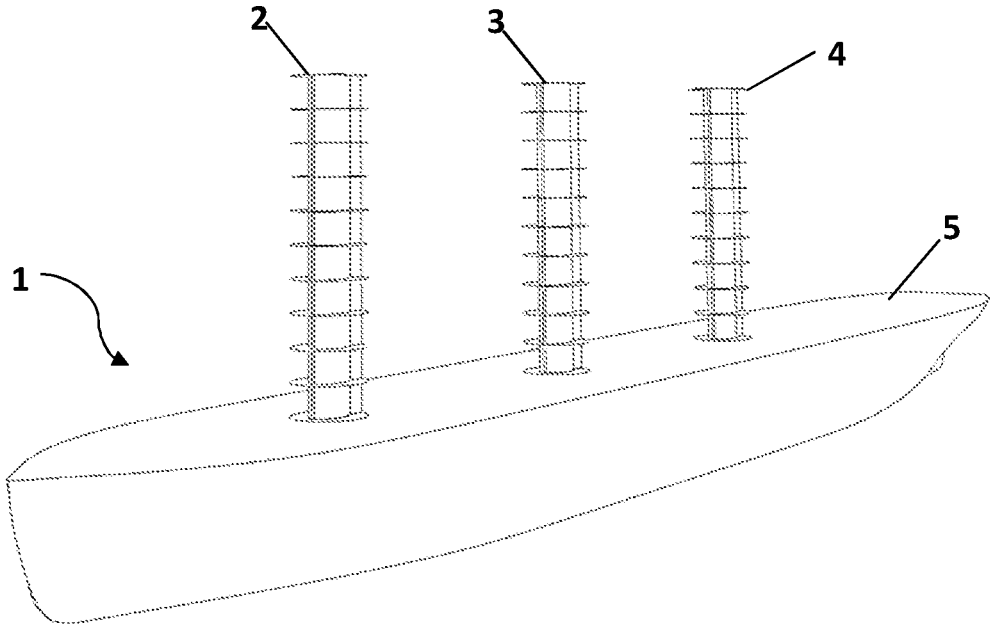
FIG. 2 shows the ship of FIG. 1 from an alternative view point.

FIGS. 1 and 2 show a ship 1 provided with first, second and third rigid sails 2, 3 and 4. The rigid sails each extend generally vertically upwards away from a top deck 5 of the ship 1. Movement of air across external surfaces of the rigid sails 2, 3 and 4 generates a lift force on the said sails, driving movement of the ship through the water. The ship is also typically provided with a primary propulsion system (including, for example, a propeller). The rigid sails typically provide the ship with an auxiliary propulsive thrust which reduces the power requirements of the primary propulsion system.

Figure 3:
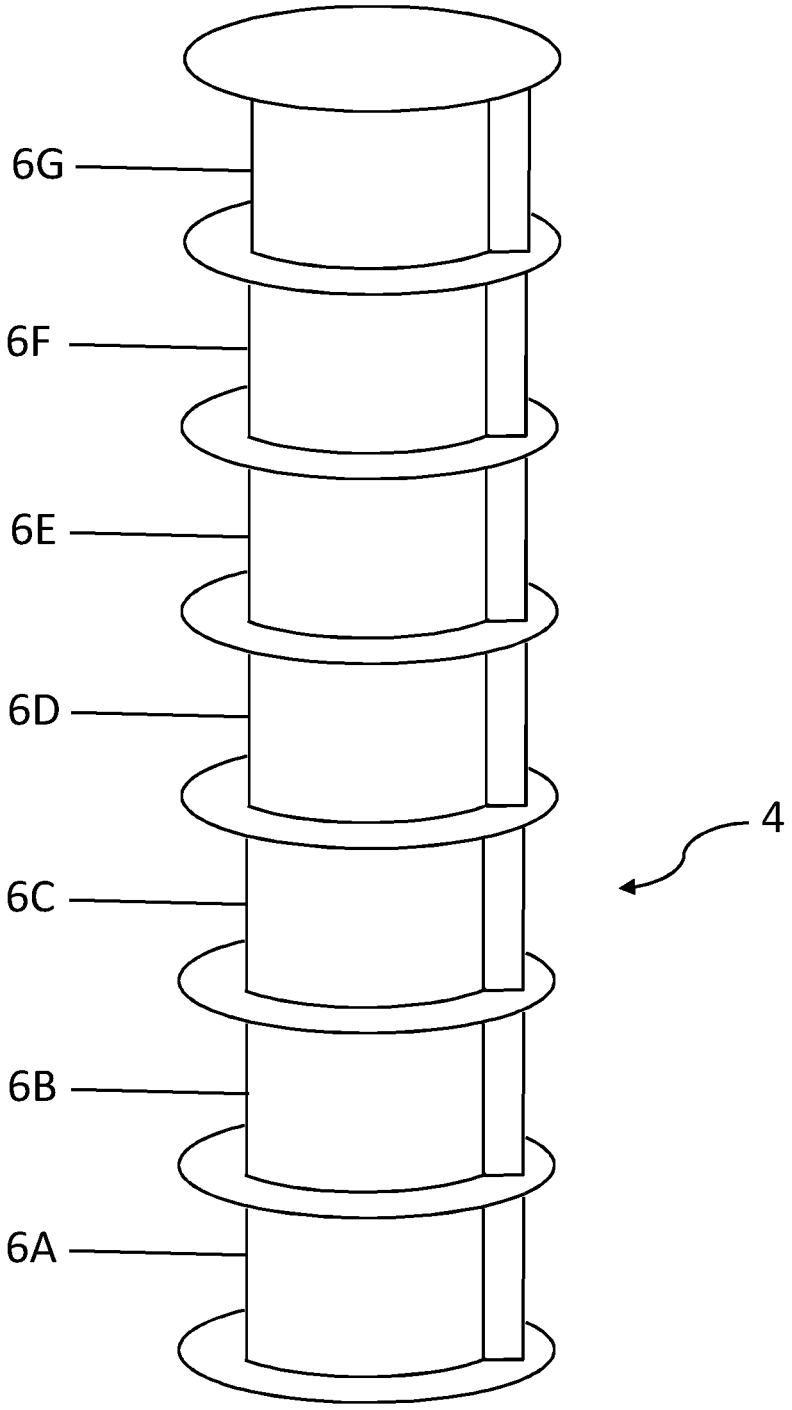
FIG. 3 shows one of the rigid, modular sails of FIGS. 1 and 2.
Figure 4:
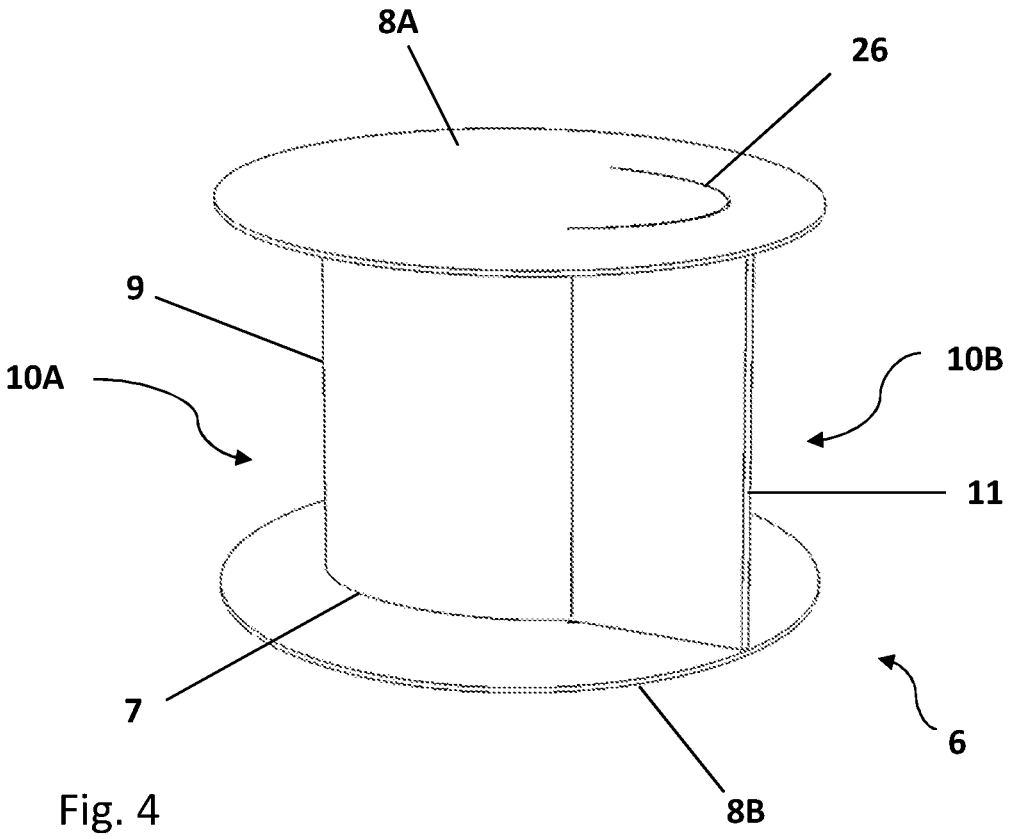
FIG. 4 shows an individual sail module from the rigid, modular sail of FIG. 3.

The rigid sail 4 is shown in more detail in FIG. 3. The sail 4 has a modular construction, comprising seven sail modules 6A, 6B, 6C, 6D, 6E, 6F and 6G stacked substantially vertically on top of one another. As shown in FIG. 4, each individual sail module 6 is formed from a sail module body 7 provided between first and second substantially circular end plates 8A and 8B. An elongate vent 9 is located at a first, geometrical leading edge end 10A of the sail module body 7, and a trailing edge flap 11 is located adjacent to a second, geometrical trailing edge end 10B of the sail module body 7.

Figure 5:
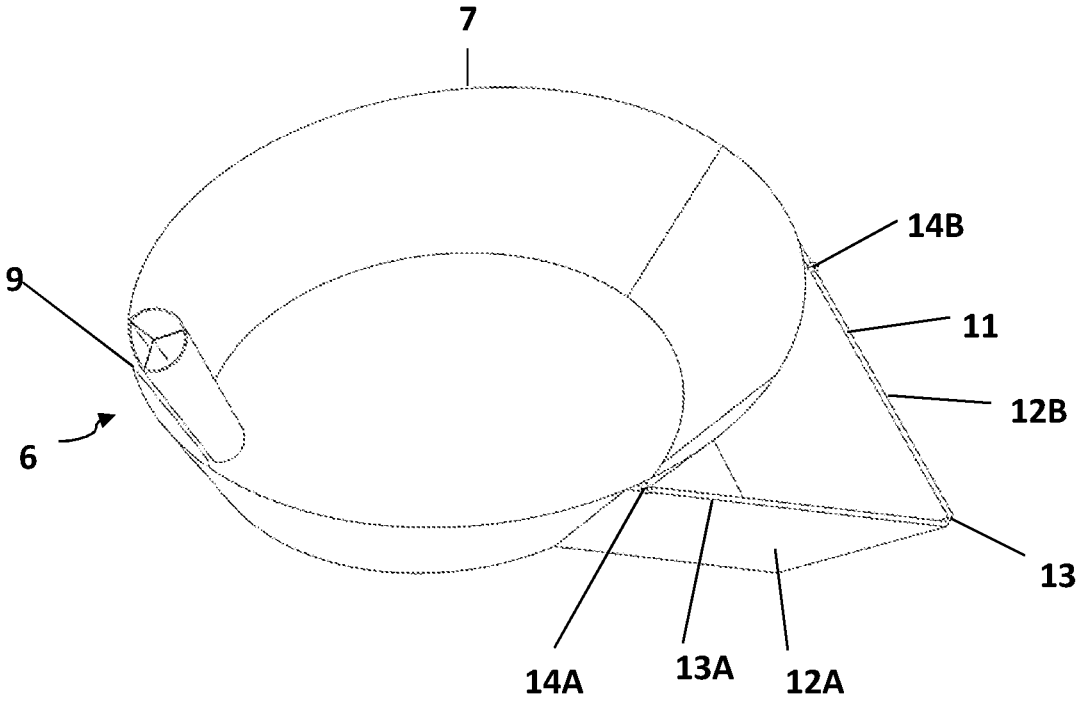
FIG. 5 shows a simplified internal structure of the individual sail module of FIG. 4 with circular end plates removed.

As can be seen in FIG. 5, the sail module body 7 is substantially hollow and is substantially tubular in shape. The elongate vent 9 extends substantially parallel to the longitudinal axis of the tubular sail module body 7. The trailing edge flap 11 is substantially prismatic in shape, having first and second wind-receiving flap surfaces 12A and 12B and a trailing edge surface 13 which, together with a portion of the external surface of the sail module body 7, form a substantially trapezoidal shape in cross-section perpendicular to the longitudinal axis of the sail module body.

The trailing edge flap 11 is slidably mounted to the sail module by way of two sliding blocks 14A and 14B provided at a first end of flap surfaces 12A and 12B. The sliding blocks 14A and 14B are retained within slot 26 in the first circular end plate 8A when the trailing edge flap 11 is mounted to the sail module body 7. Similar sliding blocks (not shown) are provided at a second end of the flap 11 and are retained within a similar slot (not shown) of the second circular end plate 8B. The trailing edge flap is movable around a trailing edge portion of the sail module body by the support blocks sliding within the end plate slots.

The trailing edge flap 11 is mounted to the sail module such that a longitudinal axis of the said flap extends substantially parallel to the longitudinal axis of the sail module body 7. In addition, a central axis (which bisects the trapezoidal flap in cross-section perpendicular to the longitudinal axis) extends away from the external surface of the sail module body at approximately 90°.

A cross-section through the sail module perpendicular to the longitudinal axis of the sail module body 7 is illustrated in FIG. 6. The tubular sail module body 7 has a generally rounded cross-section which extends from the geometrical leading edge to the geometrical trailing edge along a chord (indicated by arrow C), and which also extends along a thickness (indicated by arrow T) perpendicular to the chord. The ratio of the thickness to the chord length is approximately 2:3, which the inventors have found to provide a good structural to aerodynamic interaction, although in practice ratios between 1:2 and 1:1 are suitable.

The cross-sectional perimeter of the sail module body is substantially elliptical between the geometrical leading edge and a point approximately 75% of the way along the chord towards the geometrical trailing edge. The cross-sectional perimeter of the sail module body at the geometrical trailing edge is formed by a circular arc which extends for 90° (i.e. the arc extends symmetrically over 45° either side of the chord) and whose centre is located at the point approximately 75% of the way along the chord from the geometrical leading edge towards the geometrical trailing edge. The remainder of the cross-sectional perimeter which connects the elliptical portion to the circular portion is formed by an opportune curve which guarantees $C^2$ continuity between the two portions (i.e. continuity up to and including the second derivative of the curve).

The trailing edge flap extends away from the sail module body over a distance which is approximately one quarter of the chord length, although the inventors have found that distances between one quarter and one half of the chord length are suitable. Longer trailing edge flaps typically provide better aerodynamic performance.

As can be seen from FIG. 6, the sail module body is substantially symmetrical in cross-section (e.g. a mirror plane extends along the chord, dividing the sail module body into two substantially identical halves). The symmetrical design means that the sail module has substantially similar aerodynamic properties no matter from which side the wind approaches.

As can also be seen in FIG. 6, the sail module body 7 includes a perforated air intake 12 located at the geometrical trailing edge. The air intake is formed from a perforated area of the external surface of the sail module body. The trailing edge flap 11 is movable between two extremal positions 13A and 13B (indicated by dashed lines in FIG. 6) either side of the air intake 12.

FIG. 7 shows the internal structure of the sail module body 7 in more detail. An intake duct 14 connects the air intake 12 to an intake side of a fan assembly 15. A vent duct 16 connects a vent side of the fan assembly 15 to the vent 9. The fan assembly 15 houses a fan (not shown). The intake duct houses a plurality of intake sub-ducts (not shown), each intake sub-duct shaped to guide air from the air intake towards a specific portion of the fan-swept area. Similarly, the vent duct houses a plurality of vent sub-ducts (not shown), each vent sub-duct shaped to guide air away from a respective portion of the fan-swept area towards the vent. In use, when the fan is switched on, air is drawn (i.e. sucked) into the intake duct 14 from outside the sail module body through the air intake 12. Air is also ejected from the sail module body through the vent duct 16 and then through the vent 9. Accordingly, in use, air is drawn into the body at the geometrical trailing edge and expelled from the body at the geometrical leading edge.

A vent flow regulator 17 is provided at the vent end of the vent duct 16 within the sail module body 7. The vent flow regulator 17 is rotatable between first and second positions such that the direction of ejection of air through the vent may be controlled. When the vent duct regulator is held in the first position, air is ejected through the vent such that it flows around the sail module body in a first direction, and when the vent duct regulator is held in the second position, air is ejected through the vent such that it flows around the sail module body in a second direction opposite the first direction. As each vent sub-duct approaches the vent 9, it narrows in a direction parallel to the thickness of the air module body and expands in a direction parallel to the longitudinal axis of the sail module body. This ensures that a longitudinally elongate, pressurised jet of air is typically ejected through the vent 9 at a high speed.

Figure 8:
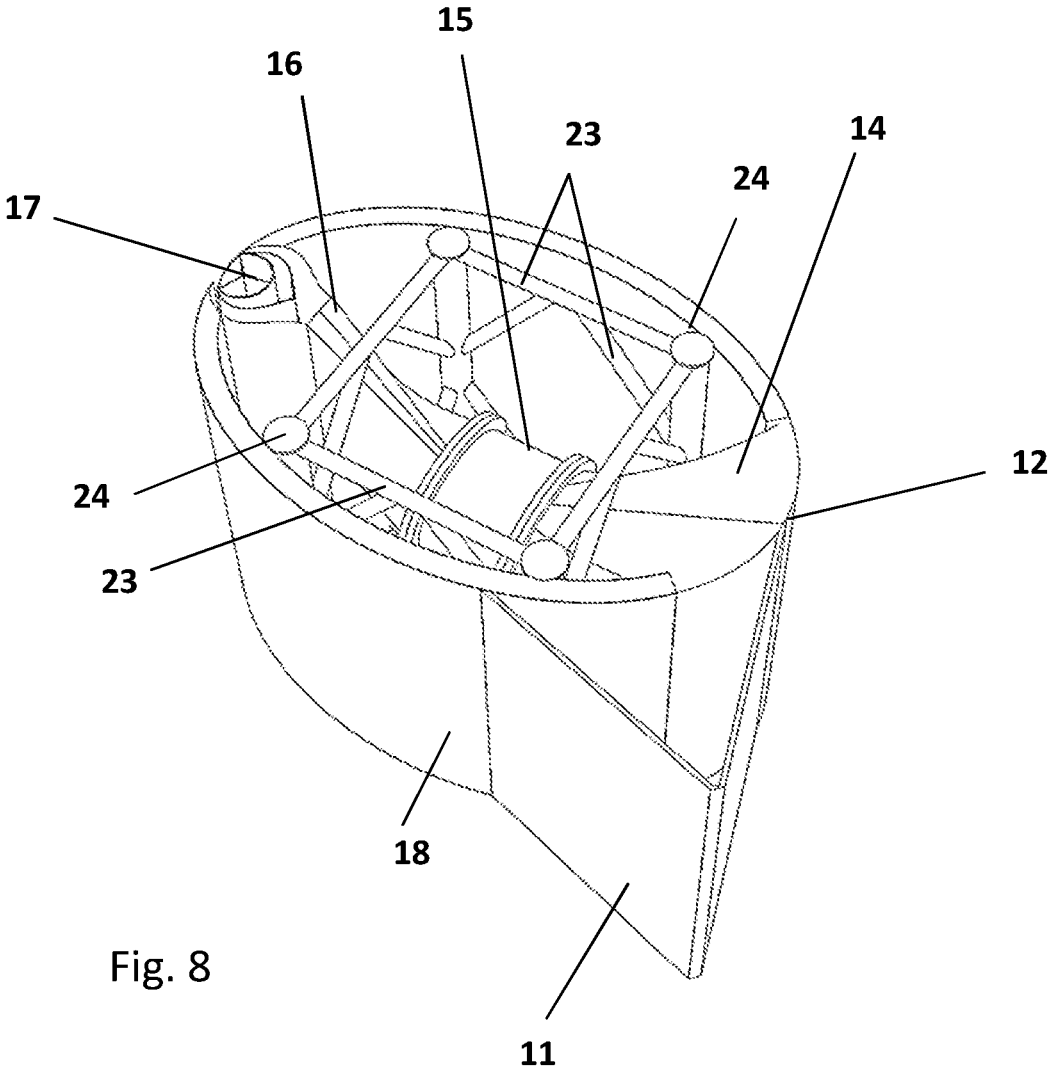
FIG. 8 shows an alternative internal structure of an individual sail module using an internal frame structure and external shell.

Also shown in FIG. 7, the external walls of the sail body module have a double-layer structure, being formed from an external shell 18 and an internal shell 19. Vertical stiffeners 20, each having an I-shaped cross-section, are provided between the external and internal shells. The internal structure of the flap is not shown in detail in FIG. 7. FIG. 8 shows an alternative construction in which a truss or frame structure is formed by struts 23 jointed at nodes 24, which supports an outer shell 25. The truss or frame structure provides the primary mechanical strength, and supports the fans, end plates and flap, and supports the outer shell which defines the shape of the wind-receiving surface.

Figure 9:
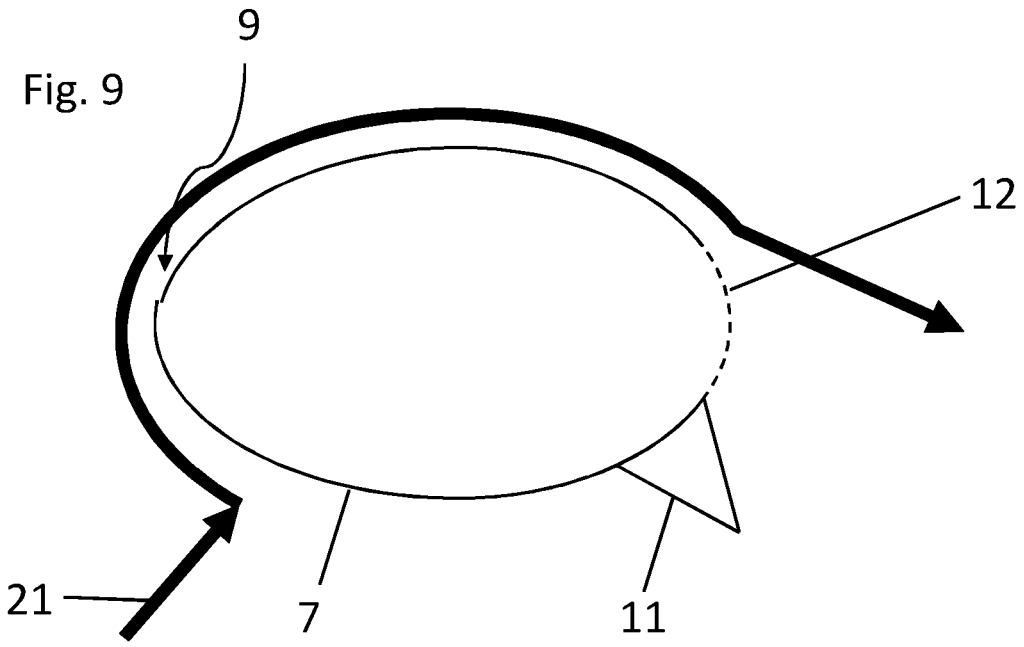
FIG. 9 shows schematically the flow path of wind across the suction surface of the individual sail module of FIG. 4.

In use, when the ship is moving through the water and/or when the wind blows, air flows over the external surfaces of each of the sail modules. The ship and/or the rigid sail is oriented such that the angle between the horizontal component of the apparent wind direction and the chord of each sail module body is non-zero (unless the wind velocity is very high, in which case the angle may be reduced to zero in order to reduce loads exerted on the sail, or if the apparent wind angle is so small that the drag force would exceed any lift generated). The trailing edge flap of each sail module is moved towards the direction from which the air flow approaches. This configuration is illustrated in FIG. 9 which shows air flow over the suction surface of the sail module. The incoming air flow, indicated by arrow 21, flows over the suction surface but detaches prior to reaching the geometrical trailing edge. Air flowing over the surface of the sail module body results in a non-zero circulation and, therefore, a lift force exerted on the sail module body according to the Kutta-Joukowski theorem. The amount of lift generated is proportional to the lift coefficient $c_L$ for the particular shape and settings of the sail module.

FIG. 9 shows the effect of switching on the internal fan such that air is drawn into the air module body through the trailing edge air intake and ejected as a jet through the leading edge vent.

Figure 10:
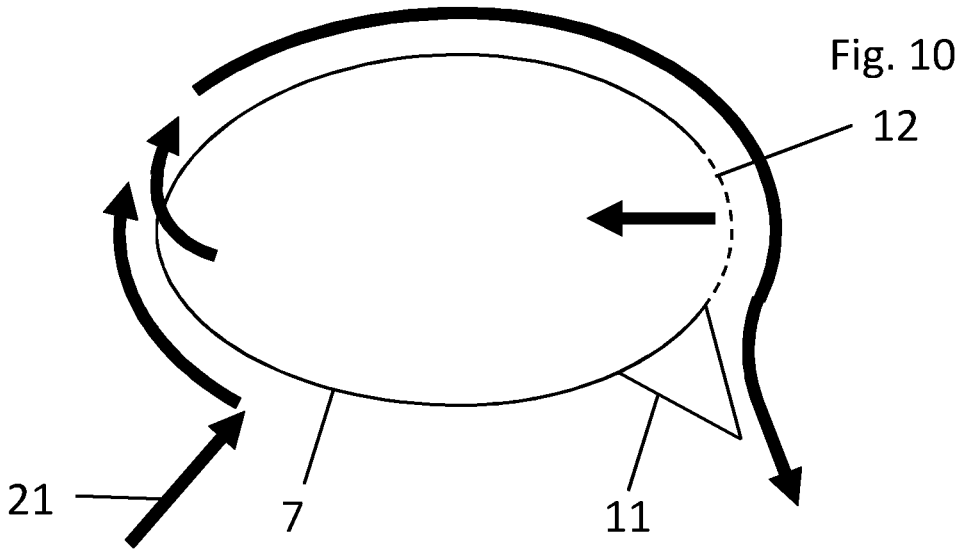
FIG. 10 shows schematically the flow path of wind across the suction surface of the individual sail module of FIG. 4 when air is drawn into the sail module at the geometrical trailing edge and ejected through a vent at the geometrical leading edge.

Suction of air through the air intake reduces air pressure at the geometrical trailing edge, increasing circulation of air around the sail module and causing the flow of air across the suction surface to remain attached over the geometrical trailing edge, beyond the point at which the air flow detaches in FIG. 9. In addition, ejection of air through the vent increases the speed of air flow across the suction surface, improving air circulation and further displacing the point of flow detachment towards the flap trailing edge. The inventors have found that by ejecting air through the vent at a speed between 1 to 8 times greater than the unaided wind-speed, the air flow may remain attached across the trailing edge air inlet and up to the trailing edge of the flap. As shown in FIG. 10, the combined effect of drawing air into the sail module body through the air intake and ejecting pressurised air out through the leading edge vent is that the detachment point is shifted back to the trailing edge of the trailing edge flap. As attached air flows over a greater suction surface area (including both a portion of the external surface of the sail module body and an external surface of the trailing edge flap), the lift coefficient $c_L$ is increased and therefore so is the amount of lift which can be generated. The inventors have found that values of between 12.5 and 14.5 are achievable.

The shape and orientation of the trailing edge flap also causes an increase in $c_L$. By holding the central axis of the trailing edge flap at approximately 45° to the sail module body chord, air typically flows smoothly from the suction surface, past the geometrical trailing edge and onto the flap. In particular, the trapezoidal shape of the trailing edge flap causes the air flow to remain attached as it approaches the transition between the sail module body and the trailing edge flap, increasing the total area of suction surface and consequently increasing the circulation and so also the lift force generated.

Figure 11:
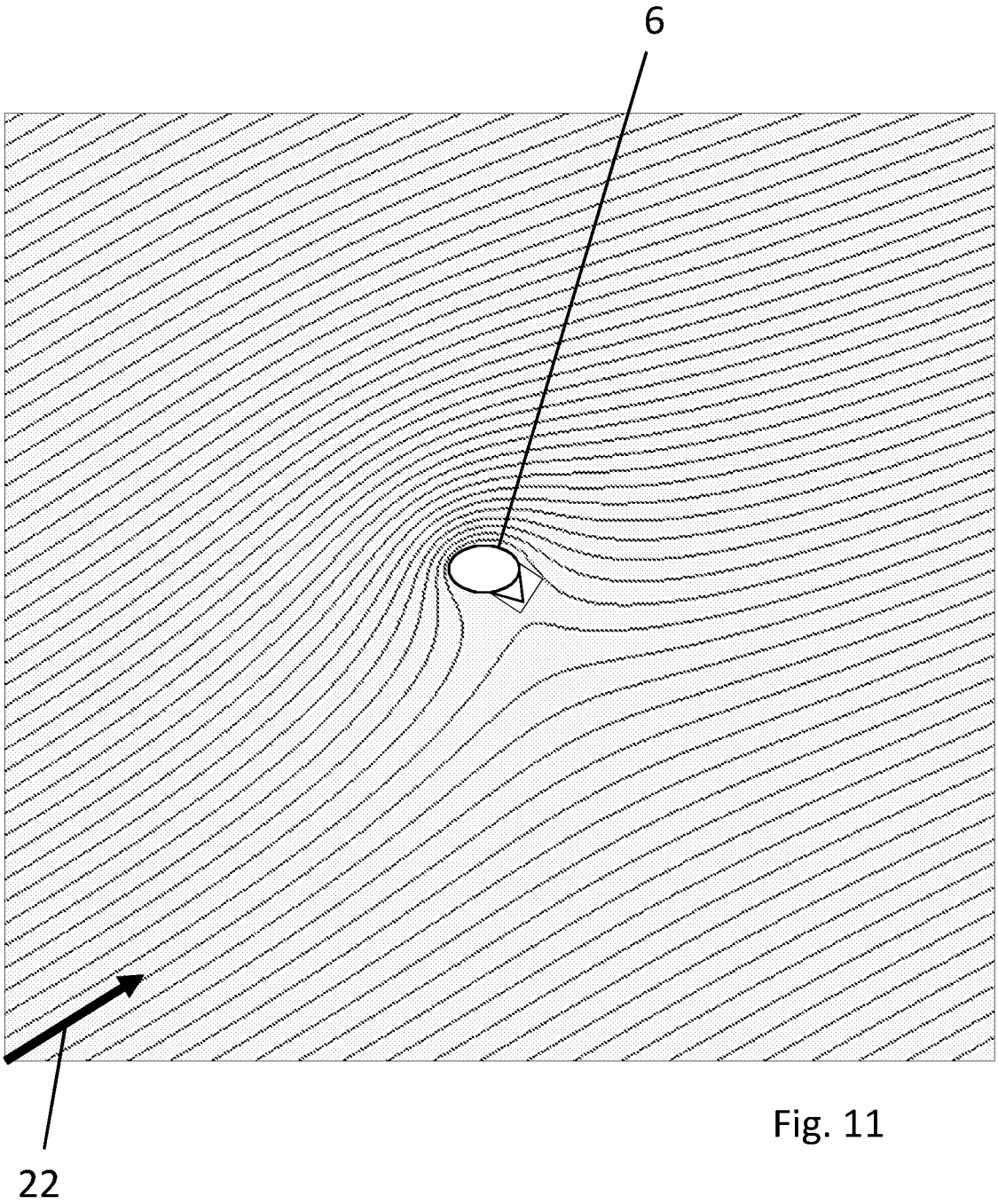
FIG. 11 shows the calculated flow path of wind around the entire cross-section of the individual sail module of FIG. 4 when air is drawn into the sail module at the geometrical trailing edge and ejected through the vent at the geometrical leading edge.
Figure 12:
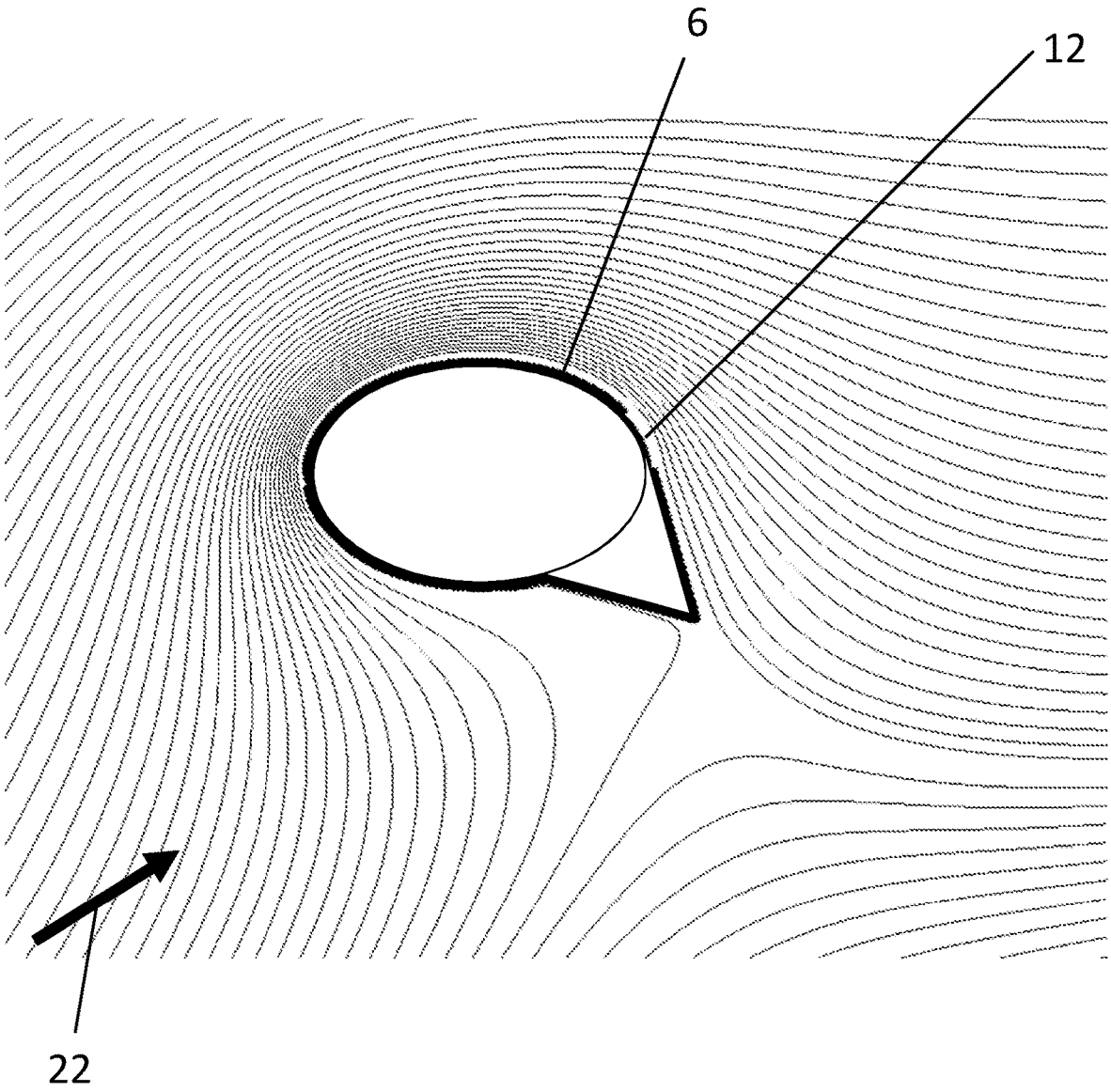
FIG. 12 shows the flow path shown in FIG. 11 in more detail.
Figure 13:
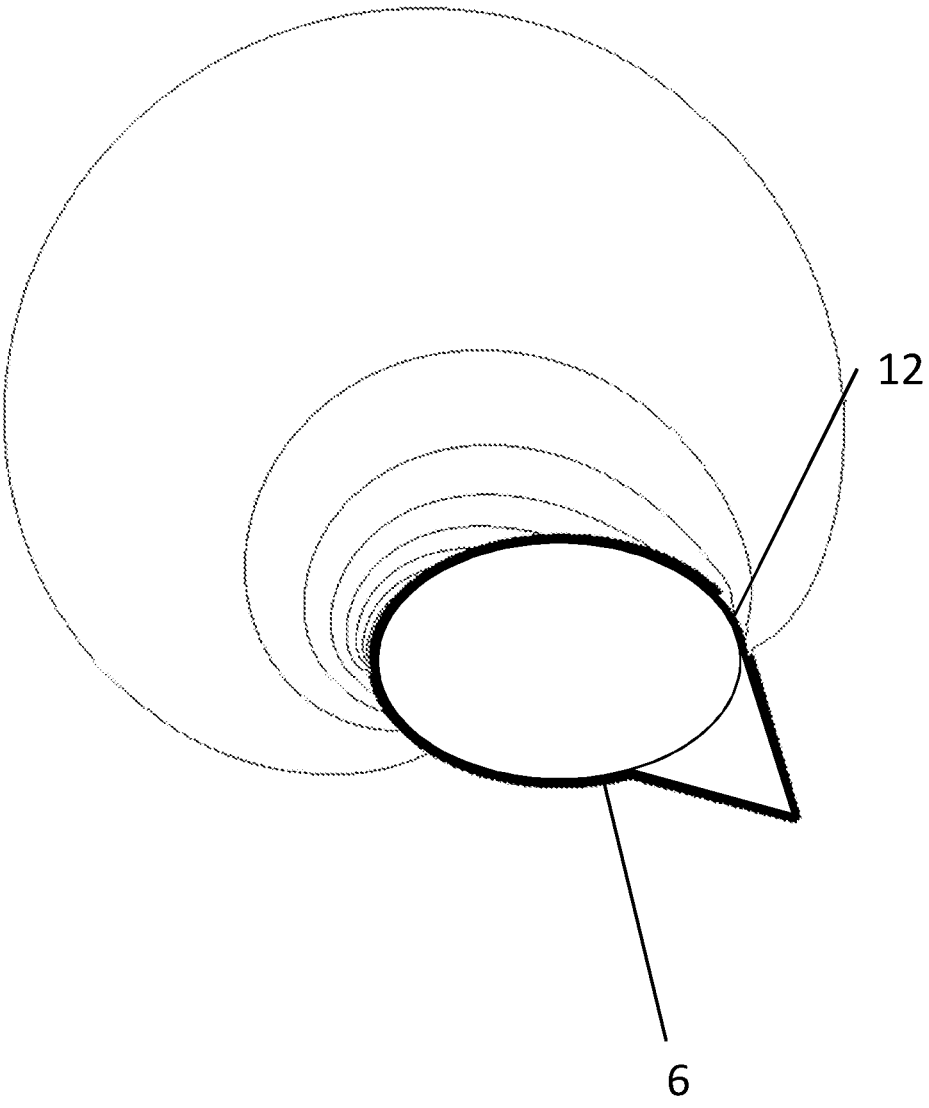
FIG. 13 shows iso-pressure contour lines between the vent and the air inlet of the individual sail module of FIG. 4 when air is drawn into the sail module through the air inlet at the geometrical trailing edge and ejected through the vent at the geometrical leading edge.

The effect of drawing air into the sail module body through the air intake and ejecting pressurised air out through the leading edge vent is illustrated in more detail in FIGS. 11, 12 and 13. FIGS. 11 and 12 show the air flow around the sail module body when air is drawn into and ejected from the sail module body. The arrow 22 indicates the predominant incoming air flow direction at large distances from the sail module body. FIG. 13 shows isopressure contour lines between the leading edge vent and the air intake.

An aerodynamic suction region, in which the air pressure is reduced and the air velocity is increased (relative to the undisturbed air flow far from the sail), extending between the aerodynamic leading edge (i.e. the stagnation point) and the aerodynamic trailing edge, is visible in FIGS. 11, 12 and 13. A corresponding aerodynamic pressure region, in which the air pressure is increased and the air velocity is decreased (relative to the undisturbed air flow far from the sail), extending between the aerodynamic leading edge and the aerodynamic trailing edge on an opposite side of the sail module body from the aerodynamic suction region, is also visible.

The aerodynamic suction and pressure regions do not correspond with the geometrical suction and pressure surfaces which extend between the geometrical leading and trailing edges around opposing sides of the sail module body (the geometrical pressure surface comprising the surface of the sail module body which would be impacted by air flow in a passive device and the geometrical suction surface being located on the side of the sail module body opposite the geometrical pressure surface). In fact, it can be seen that the deflection of the air flow is so significant that the aerodynamic leading edge (i.e. the stagnation point) is displaced away from the geometrical leading edge, along the geometrical pressure side, towards the geometrical trailing edge. Displacement of the aerodynamic leading edge leads to a reduction in the surface area of the aerodynamic pressure region and an increase in the surface area of the aerodynamic suction region. In particular, it can be seen that the stagnation point almost coincides with the trailing edge of the trailing edge flap. At the same time, the flow separation point is moved away from the geometrical leading edge, along the geometrical suction surface, towards the trailing edge of the trailing edge flap. This further reduces the surface area of the aerodynamic pressure region and increases the surface area of the aerodynamic suction region. In FIG. 12, the aerodynamic leading edge almost coincides with the aerodynamic trailing edge, approaching the ideal condition of a zero-length aerodynamic pressure region in which the circulation, and therefore the lift, is maximised.

The trailing edge air inlet may be formed by circular or triangular perforations in the external surface of the sail module body. Alternatively, the trailing edge air inlet may be louvred, rather than perforated, meaning that the inlet may be formed by an array of elongate slats and apertures. The louvre slats may be rectangular in cross-section, or they may be shaped as aerofoils. A good air inlet permeability is of the order of 45%, meaning that 45% of the exposed inlet surface is open aperture. The permeable area of the air inlet typically extends back from the geometrical trailing edge towards the geometrical leading edge along between 2% and 7% of the length of the chord. In order to maintain flow attachment right up to the geometrical trailing edge or the trailing edge of the trailing edge flap, between 1% and 7% of air flow approaching the sail (calculated as the product of the wind velocity, the chord length, the longitudinal axis length and a factor of ⅔) should be sucked into the sail module bodies. A flow ratio of 6% typically ensures that flow remains attached for an angle of attack of 30° and a jet velocity ⅛ times greater than the undisturbed wind velocity.

In use, the angle of attack may be adjusted by rotating each sail about its longitudinal axis. The position of each trailing edge tail may be adjusted such that it is always provided on the pressure surface of the respective sail module body.

The ship and/or the sails may include one or more wind-characterising sensors operable (i.e. configured) to determine one or more properties (such as the wind velocity, i.e. wind speed and wind direction) of an approaching wind field. Wind-characterising sensors may comprise LIDAR sensors. Each sail may be rotated, and each trailing edge flap may be moved, in response to the outputs from the wind-characterising sensors, in order to achieve an optimum angle of attack for maximum lift generation.

In use, the trailing edge flap may also sometimes be held at the trailing edge (i.e. at equal distances from the first and second extremal positions either side of the air intake), in order to reduce drag forces acting on the sail. Reduction in drag is important when the apparent wind angle is so small that the driving force is mainly composed of drag, or when the apparent wind velocity is so high that the air flow cannot stay attached to the device even with the assistance of the air inlet suction and the leading edge jet.

It will be understood that different sail geometries are possible. It may be that the cross-section of the sail module body is substantially elliptical. It may be that the elliptical cross-sectional shape begins at the geometrical leading edge and extends up to between 50% and 100% of the chord length. The remaining portion of the cross-sectional shape may be circular.

The trailing edge flap may be rectangular in shape, or shaped like an aerofoil. The trailing edge flap can be mounted to the end plates and/or directly to the sail module body. If the trailing edge flap is mounted only to the end plates and not directly to the sail module body, typically one sliding rail is provided on each end plate. If the trailing edge flap is mounted to the sail module body, typically two, three or more sliding rails are provided, spaced apart along the longitudinal axis. The sliding rails may extend across the air inlet.

The end plates may be circular or they may take other shapes. For example, the end plates may be elliptical.

Each sail body module is typically around 2.5 metres to 5 metres in height. The length of the chord of each sail module body is typically similar to (e.g. equal to) the height of the said sail module body. The thickness of each sail module body is typically ⅔ times the length of the respective chord.

The modular sail structure means that individual sail module bodies can be removed, replaced and transported easily. It also means that the sail can be reconfigured for use on different ships. The periodic array of end plates tends to restrict flow of air in a direction parallel to the longitudinal axis of the sail, ensuring that air flows principally from the leading towards the trailing edge of each sail module body.

Further variations and modifications may be made within the scope of the invention herein disclosed.

The invention claimed is:

1. Propulsion apparatus for an aquatic vessel, the propulsion apparatus comprising an aerodynamic body which extends along a longitudinal axis between first and second ends and in a transverse direction between a leading edge and trailing edge, the aerodynamic body having one or more external wind-receiving surfaces which extend between the leading edge and the trailing edge, thereby defining an aerodynamic profile of the aerodynamic body in cross-section substantially perpendicular to the longitudinal axis, wherein the propulsion apparatus further comprises at least one air vent and at least one air flow generator configured to expel air through the at least one air vent, the at least one air vent and the at least one air flow generator being configured to direct expelled air across at least a portion of the one or more or more external wind-receiving surfaces, and wherein the at least one air vent is located in a leading region of the aerodynamic body.

2. The propulsion apparatus according to claim 1, wherein the at least one air vent comprises at least one elongate vent aperture.

3. The propulsion apparatus according to claim 1, wherein the at least one air flow generator is configured to expel air from within the aerodynamic body, through the at least one vent, to outside the aerodynamic body.

4. The propulsion apparatus according to claim 1, wherein the at least one air flow generator comprises a fan or a pump.

5. The propulsion apparatus according to claim 4, wherein the at least one air flow generator is located inside the aerodynamic body.

6. The propulsion apparatus according to claim 4 further comprising one or more channels provided between the or one of the at least one air flow generators and the or one of the at least one air vents, the one or more channels being configured to guide air from the or one of the at least one air flow generators towards the or one of the at least one air vents, wherein the or each of the one or more channels narrows along a length of the said channel from the at least one air flow generator towards the at least one air vent.

7. The propulsion apparatus according to claim 1 further comprising at least one air vent flow regulator operable to regulate the speed and direction of flow of air through the at least one vent.

8. The propulsion apparatus according to claim 1 further comprising at least one air intake, located at or adjacent to the trailing edge of the aerodynamic body, the at least one air flow generator being configured to draw air through the at least one air intake.

9. The propulsion apparatus according to claim 1 further comprising at least one flap projecting from the aerodynamic body.

10. The propulsion apparatus according to claim 1, wherein:

the propulsion apparatus further comprises at least one air intake; and the at least one air flow generator is further configured to draw air through the at least one air intake, the at least one air intake being, in an operating configuration, located at or extending across the trailing edge of the aerodynamic body.

11. The propulsion apparatus according to claim 10 wherein the at least one air flow generator is configured to expel air through the at least one air vent, the at least one air vent and the at least one air flow generator being configured to direct expelled air across at least a portion of the one or more or more external wind-receiving surfaces.

12. The propulsion apparatus according to claim 10, wherein the at least one air intake comprises a plurality of open apertures through which air may be drawn.

13. The propulsion apparatus according to claim 1, wherein:

the propulsion apparatus further comprises at least one air intake, the at least one air flow generator is configured to draw air through the at least one air intake, the propulsion apparatus further comprises at least one flap, the at least one air intake is located at or extending across the trailing edge of the aerodynamic body in an operating configuration, and the at least one flap is movable between a first flap position, in which the at least one flap is provided to one side of the trailing edge, and a second flap position, in which the at least one flap is provided to an opposing side of the trailing edge.

14. The propulsion apparatus according to claim 13, wherein, when the at least one flap is in the first or the second flap positions, at least a portion of the at least one air intake is covered by at least a portion of the flap.

15. The propulsion apparatus according to claim 13, wherein, when the at least one flap is in the first or the second flap positions, the at least one air intake is not covered by the at least one flap and wherein the at least one flap is releasably retainable in the first flap position and the at least one flap is releasably retainable in the second flap position.

16. The propulsion apparatus according to claim 13, wherein the at least one flap is configured such that, when the flap is in the first or the second flap position, at least one external wind-receiving surface of the said flap extends substantially tangentially away from one or more of the external wind-receiving surfaces of the aerodynamic body.

17. The propulsion apparatus according to claim 13, wherein the at least one flap is substantially triangular or substantially trapezoidal in cross-section perpendicular to the longitudinal axis of the aerodynamic body.

18. The propulsion apparatus according to claim 17, wherein one or more sides of the substantially triangular or substantially trapezoidal cross-sections of the at least one flap are flat.

19. The propulsion apparatus according to claim 17, wherein one or more sides of the substantially triangular or substantially trapezoidal cross-sections of the at least one flap are concave.

* * * * *